US005781212A

United States Patent [19]

Burr et al.

[11] Patent Number: 5,781,212

[45] Date of Patent: Jul. 14, 1998

[54] PURGEABLE MULTIPLE-ORIFICE DROP-ON-DEMAND INK JET PRINT HEAD HAVING IMPROVED JETTING PERFORMANCE AND METHODS OF OPERATING IT

[75] Inventors: Ronald F. Burr, Wilsonville, Oreg.; Laurent A. Regimbal, Boise, Id.

[73] Assignee: Tektronix, Inc., Wilsonville, Oreg.

[21] Appl. No.: 844,802

[22] Filed: Apr. 22, 1997

Related U.S. Application Data

[63] Continuation of Ser. No. 140,344, Oct. 20, 1993, abandoned.

[51] Int. Cl.[6] ..... B41J 2/17

[52] U.S. Cl. ..... 347/84; 347/94

[58] Field of Search ..... 347/94, 40, 71, 347/92, 84

[56] References Cited

U.S. PATENT DOCUMENTS

| | | | |
|---|---|---|---|
| 4,216,477 | 8/1980 | Matsuda et al. | 346/140 R |
| 4,233,610 | 11/1980 | Fischbeck et al. | 347/94 |
| 4,367,480 | 1/1983 | Kotoh | 346/140 R |
| 4,387,383 | 6/1983 | Sayko | 346/140 R |
| 4,521,788 | 6/1985 | Kimura et al. | 346/140 R |
| 4,528,575 | 7/1985 | Matsuda et al. | 346/140 R |
| 4,528,578 | 7/1985 | Balbo | 346/140 R |
| 4,631,553 | 12/1986 | Sekiya | 347/94 |
| 4,680,595 | 7/1987 | Cruz-Uribe et al. | 346/140 R |
| 4,727,378 | 2/1988 | Le et al. | 346/140 R |
| 4,730,197 | 3/1988 | Raman et al. | 346/140 R |
| 4,883,219 | 11/1989 | Anderson et al. | 228/190 |
| 4,897,674 | 1/1990 | Hirasawa | 346/140 R |
| 4,965,595 | 10/1990 | Yoshimura | 346/140 R |
| 5,087,930 | 2/1992 | Roy et al. | 346/140 R |
| 5,459,498 | 10/1995 | Seccombe et al. | 347/18 |
| 5,513,431 | 5/1996 | Ohno et al. | 29/890.1 |
| 5,534,900 | 7/1996 | Ohno et al. | 347/54 |

FOREIGN PATENT DOCUMENTS

| | | | |
|---|---|---|---|
| 56-172 | 1/1981 | Japan . | |
| 4-355146 | 12/1992 | Japan | 347/94 |

*Primary Examiner*—Benjamin R. Fuller
*Assistant Examiner*—Juanita Stephens
*Attorney, Agent, or Firm*—Ralph D'Alessandro; Richard Preiss

[57] ABSTRACT

An ink jet print head (10) has a supply channel (14, 24, 52) connecting an ink source with an upper manifold (60U) and a lower manifold (60L). Each manifold has a tapered structure. From each manifold multiple inlet channels (36, 34, 44, 54) each lead to a respective pressure chamber (28) from which an outlet channel (40, 38, 46, 56, 62, 76, 82) leads to nozzles (88) from which droplets of liquid ink are expelled as a result of the action of a pressure transducer on the pressure chamber. Each manifold is separated from the supply channel by a baffle structure (92) that includes three baffles (94) formed by alternating plates (64, 78) having an open manifold with plates (58, 72) having a blocked manifold. The baffle structure reduces jetting nonuniformity by damping pressure displacement waves in the ink caused by the expulsion of ink droplets. The baffle structure also promotes effective heat transfer from the print head to ink being drawn in to the print head from the ink source. The print head is operated by drawing ink from the supply channel through the baffle structure to replace ink drawn from the manifold as a result of expulsion of ink from the nozzles.

30 Claims, 18 Drawing Sheets

PURGEABLE MULTIPLE-ORIFICE DROP-ON-DEMAND INK JET PRINT HEAD HAVING IMPROVED JETTING PERFORMANCE AND METHODS OF OPERATING IT

This is a continuation of application Ser. No. 08/140,344 filed Oct. 20, 1993, which is now abandoned.

TECHNICAL FIELD

The present invention pertains to multiple-orifice drop-on-demand ink jet printers and, in particular, to ink jet print heads for such printers.

BACKGROUND OF THE INVENTION

Ink jet printers place an image on a surface of a substrate (such as a piece of paper) by ejecting droplets of liquid ink in a controlled pattern from one or more arrays of multiple nozzles. Ink jet printers include an ink source (such as a reservoir) fluidically connected to a print head; the print head typically shuttles back and forth across the surface of the substrate, and that surface is periodically advanced to allow the print head to print on an area of that surface. The print head contains an ink pathway for conveying liquid ink to the nozzles and drive mechanisms, such as pressure chambers bounded by a thin diaphragm coupled to pressure transducers actuated by an electronic driver, for causing the print head to expel the ink droplets in the controlled fashion.

Ordinarily the print head contains multiple channels, one for each of the nozzles, each of which conveys liquid ink to one pressure chamber and from that pressure chamber to one nozzle. Typically each of those channels draws liquid ink from a larger channel or manifold, also in the print head, that is in fluid connection with the ink source through a supply channel that is often much longer than the channels that convey liquid ink from the manifold to the pressure chambers. When an ink jet printer is to print more than one color of ink, separate manifolds are provided for each different color of ink.

As a pressure chamber is alternately actuated and relaxed, it alternately increases and decreases the pressure in liquid ink in the channel leading from the chamber to the nozzle with which that chamber is associated and also in the channel leading to that chamber from the manifold. Such an increase in pressure is necessary to expel a droplet of ink from the nozzle; such a decrease is necessary to refill the pressure chamber with ink.

However, such pressure changes can propagate back from the pressure chamber to the manifold. Once in the manifold, such pressure changes can affect the pressure at other pressure chambers leading from the manifold, causing non-uniformity in the jetting characteristics from the nozzles. Non-uniform jetting can interfere with proper formation of an image on the substrate and become visible as a variation in the intensity of a printed image or of a color in a color printed image. Uniform jetting performance is generally enhanced by making the fluid characteristics of the channels leading from the ink source to the nozzles substantially identical.

In addition, U.S. patent application Ser. No. 08/056,346 of Burr et al., filed Apr. 30, 1993, now U.S. Pat. No. 5,455,615, for A MULTIPLE-ORIFICE DROP-ON-DEMAND INK JET PRINT HEAD HAVING IMPROVED PURGING AND JETTING PERFORMANCE ("the co-pending application"), which is assigned to the assignee of the instant application, discloses that uniform jetting performance is enhanced by eliminating bubbles entrapped in liquid ink in the print head. FIGS. 1A–1B and 8A–8B of the copending application show earlier print head designs having ink passageways with various constrictions, changes in cross-section, and changes in exposed surface area between an ink source (not shown) and upper and lower manifolds. One of those earlier designs (FIGS. 1A–1B) does not, but the other (FIGS. 8A–8B) does, have tapered manifolds. Both of those earlier designs produced sufficient jetting nonuniformity that it was desirable to reduce that nonuniformity.

The co-pending application attributes the jetting nonuniformity of those two earlier designs to bubbles entrapped in liquid ink in the manifolds. It explains the problems caused by entrapped bubbles and discloses an improved ink jet print head designed to reduce or eliminate such bubbles. That print head has a pair of tapered upper and lower ink supply manifolds, each of which slopes upward, for each different color of ink to be printed by the print head. Multiple inlet channels, each leading to its respective pressure chamber, lead from the upper edge of the tapered manifolds, and the manifolds are tapered in the direction from an ink supply channel toward the top end of the upper edge of the manifold. That design effectively eliminates entrapped bubbles during normal operation and purging and thereby reduces jetting nonuniformity.

As disclosed in the co-pending application, the ink supply manifold can be designed to have a resonant frequency above the jetting frequency at which an ink jet print head is to operate. However, it has been discovered that, even with the design disclosed in the co-pending application, undesirable jetting nonuniformities remain.

Further jetting nonuniformities can result from thermal gradients in the ink within the print head that create changes in the viscosity of the ink at different locations within the print head. This results in varying ejection velocities of the ink drops, different ink drop sizes, different time to media rates, and poor image quality reflected in banding on the print output.

Thus, there is a need for an ink jet print head that effectively eliminates bubbles during normal operation and purging and that exhibits improved jetting uniformity.

SUMMARY OF THE INVENTION

Accordingly, an object of the invention is to provide a ink jet print head that effectively eliminates bubbles during normal operation and purging and that exhibits improved jetting uniformity.

It is another object of the invention to obtain uniform ink temperature throughout the manifolds in the print head.

We have discovered a source of jetting non-uniformity that remains when tapered manifolds as disclosed in the co-pending application are used. When an ink pressure chamber operates to cause expulsion of ink through a nozzle, pressure waves develop in the ink inlet channel leading to that pressure chamber, in the ink supply manifold to which that ink inlet channel opens, and in the ink supply channel leading from the ink source to the ink supply manifold.

One of those pressure waves occurs as ink is sucked into the pressure chamber to refill it as it expands following the expulsion of ink through its associated nozzle. That pressure wave enters the ink supply manifold and reduces the pressure in the ink supply manifold because ink cannot quickly be resupplied. The repetitive firing of the ink pressure chambers can cause acoustic pressure waves in the liquid ink in the ink supply manifold and in the supply channel leading from the ink source to the ink supply manifold.

The tapered manifold disclosed in the co-pending application raises the resonant frequency of the manifold and spreads that resonant frequency so as to increase the width of the resonance peak of the manifold; that effect reduces the sharpness of the acoustic response of the manifold to acoustic pressure waves caused by firing of the pressure chambers. However, the associated pressure waves are not eliminated by the tapered manifolds.

To reduce the acoustic pressure waves to a level that interferes less with jetting uniformity, a damping or baffle structure is introduced between the manifold and the supply channel of an ink jet print head. The print head has multiple printing nozzles in fluid communication with the supply channel. A group of inlet channels is in fluid connection with the manifold; each of the inlet channels leads from the manifold to a respective one of a group of pressure chambers, each of which is operable to cause the discharge of liquid ink through a respective one of the nozzles. The print head also has manifold in fluid connection between the supply channels and the group of inlet channels. The damping or baffle structure is located between the supply channel and the manifold and defines plural fluid passageways between them.

The damping or baffle structure may define fluid passageways between the supply channel and the manifold. The damping or baffle structure may have a fluid aspect ratio above about 5 or about 10. It may be of a character that permits bubbles entrapped in it in liquid ink to flow up and away from it when the print head is in normal operation. The print head may have two manifolds, each having a damping or baffle structure between it and a common supply channel; where two manifolds are present, one may be located above the other when the print head is in normal operation. The operation of the pressure chambers to expel ink through the nozzles creates pressure waves in the manifold. The damping or baffle structure should have sufficient fluid resistance to reduce reflection of such pressure waves back into the manifold to an extent sufficient to reduce jetting nonuniformity.

The invention also provides a method of operating an ink jet print head having multiple nozzles, each in fluid connection with a respective one of pressure chambers containing ink. In the method the pressure chambers are actuated so as to expel ink from the nozzles; the pressure chambers are resupplied with ink drawn from a manifold. The manifold is resupplied with ink by passing ink from a supply channel through a damping or baffle structure having sufficient fluid resistance to reduce the amplitude of pressure waves reflecting from the damping structure to the manifold to a sufficient extent to reduce jetting nonuniformity to an acceptable level. The damping or baffle structure provided may define at least three fluid passageways; it may comprise two parallel plates, each having major surfaces oriented parallel to the direction of fluid flow; the plate surfaces may be oriented vertically.

BRIEF DESCRIPTION OF THE DRAWINGS

These and other objects, features, and advantages of the invention will become apparent upon consideration of the following detailed disclosure of the invention, especially when it is taken in conjunction with the accompanying drawings, in which.

DETAILED DESCRIPTION OF THE PREFERRED EMBODIMENT

The co-pending application and U.S. patent application Ser. No. 07/894,316 of Crawford et al. for A DROP-ON-DEMAND INK JET PRINT HEAD HAVING IMPROVED PURGING PERFORMANCE, filed Jun. 4, 1992, which is also assigned to the assignee of the instant application, are hereby incorporated herein by reference.

Figure 1:
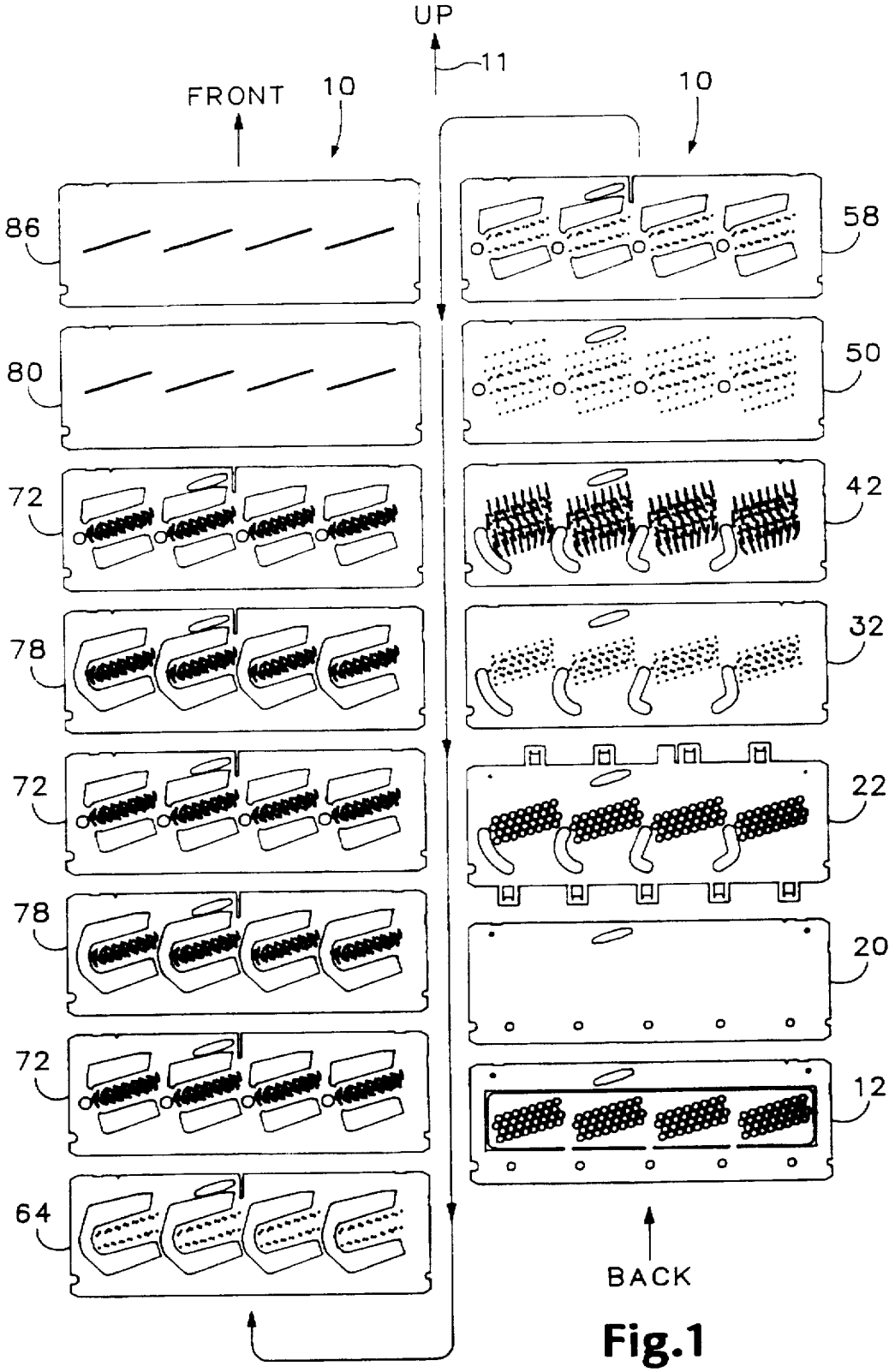
FIG. 1 is a plan view of various plates used to make an ink jet print head according to the invention.

FIG. 1 is a plan view of various plates used to make an ink jet print head 10 according to the invention. The plates, shown separated in FIG. 1, are stacked in face-to-face registration with one another and in the front-to-back order indicated in FIG. 1, and then brazed together, to form a mechanically unitary and operational print head 10. The plates, and the Figures in which they are shown in enlarged view, are as follows: a spacer plate 12 (FIG. 2); a diaphragm plate 20 (FIG. 3); a pressure chamber plate 22 (FIG. 4); a pressure chamber inlet separator plate 32 (FIG. 5); an inlet plate 42 (FIG. 6); a manifold/inlet separator plate 50 (FIG. 7); a blocked manifold/inlet front separator plate 58 (FIG. 8); an open manifold/inlet front separator plate 64 (FIG. 9); a blocked manifold plate 72 (three are used) (FIG. 10); an open manifold plate 78 (two are used) (FIG. 11); an orifice/manifold separator plate 80 (FIG. 12); and an orifice plate 86 (FIG. 13). When print head 10 is operated, it is oriented vertically such that the direction of "up" arrow 11 is perpendicular to the surface of the earth.

Print head 10 defines four separate fluid pathways: one for black, and one for each of the subtractive primary colors cyan, yellow, and magenta. The inks used are typically light-transmissive phase-change ink in the liquid phase of the types described in U.S. Pat. Nos. 4,889,560 to Jaeger et al. and 4,889,761 to Titterington et al., each of which is assigned to the assignee of the instant application. However, alternatively, other inks could be used, or the number of separate ink pathways could be varied depending upon whether a print head is to print solely in black ink or with less than a full range of color.

In the following discussion a suffix K, M, Y, or C indicates structure or a part of a pathway for respective black, magenta, yellow, or cyan ink, and a suffix U or L indicates structure or a part of a pathway for respective upper or lower ink manifolds. The use without such a suffix of a reference numeral referring to plural parts associated with ink of more than one color refers to all such plural parts. Ink colors can be allocated to the pathways in print head 10 in arrangements other than that shown.

Figure 2:
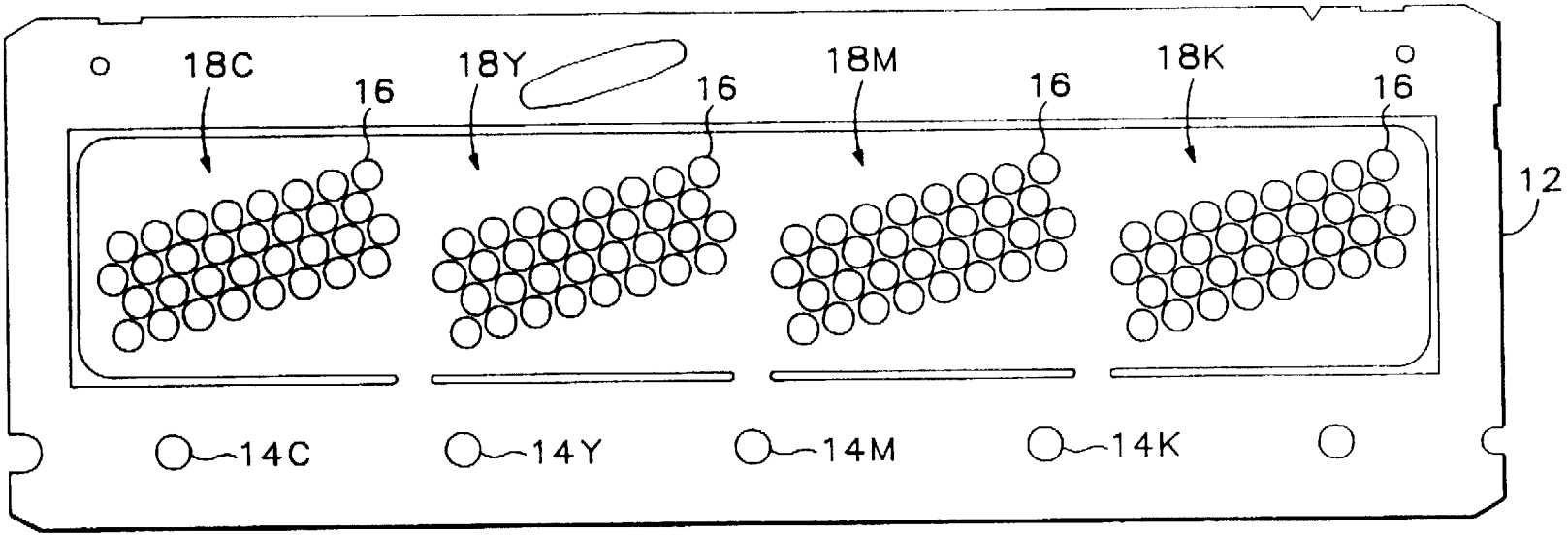
FIG. 2 is an enlarged view of a spacer plate shown in FIG. 1.

FIG. 2 is an enlarged view of spacer plate 12, which shows ink supply openings 14K, 14M, 14Y, and 14C. Plate 12 also defines multiple recesses 16, which are removed prior to the bonding of the pressure transducer to the diaphragm in plate 20. The openings 14 form the beginning of the four separate fluid pathways within print head 10.

Figure 3:
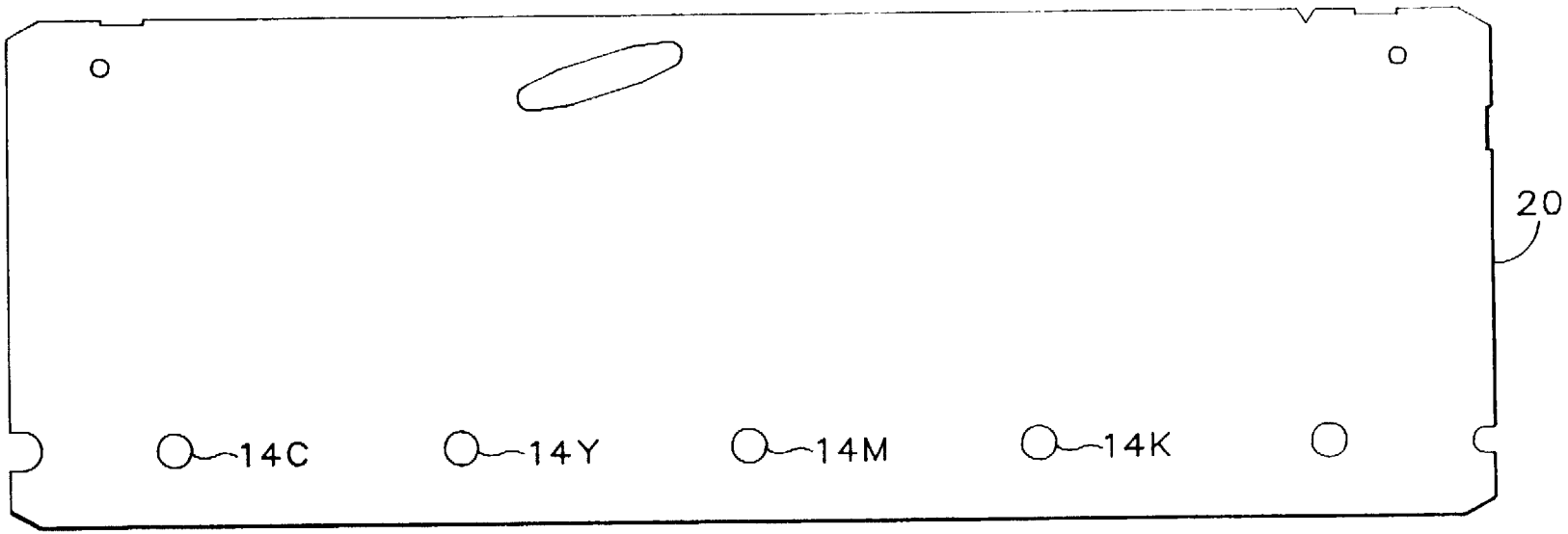
FIG. 3 is an enlarged view of a diaphragm plate shown in FIG. 1.

FIG. 3 is an enlarged view of diaphragm plate 20, which defines a further part of supply openings 14K, 14M, 14Y, and 14C. Plate 20 is flexible under force supplied by the pressure transducers; it is preferably about 0.1 millimeter (0.004 inch) thick.

Figure 4:
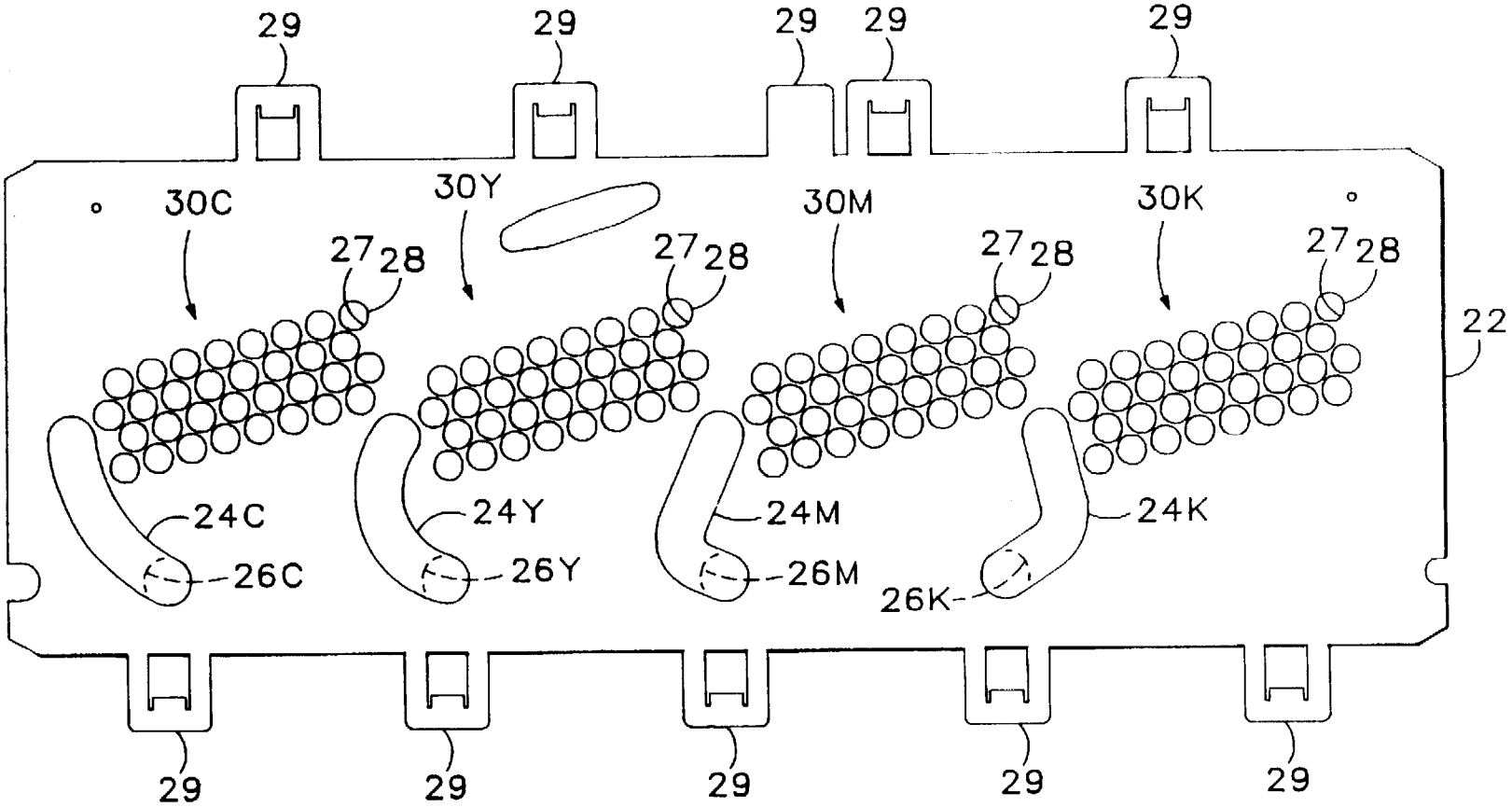
FIG. 4 is an enlarged view of a pressure chamber plate shown in FIG. 1.

FIG. 4 is an enlarged view of pressure chamber plate 22. Plate 22 defines part of volumes 24K, 24M, 24Y, and 24C, which have respective portions 26K, 26M, 26Y, and 26C that are in alignment with and lead to respective supply openings 14K, 14M, 14Y, and 14C (plates 12 (FIG. 2) and 20 (FIG. 3)) when plates 12, 20, and 22 are in registration. Although volumes 24K, 24M, 24Y, and 24C are of different shapes, the dimensions of each of those volumes are chosen so that each of those volumes has the same fluid resistance, capacitance, and inductance to promote uniform jetting among the four colors in the four separate fluid pathways. Plate 22 also defines in part multiple pressure chambers 28 formed in arrays 30K, 30M, 30Y, and 30C. Pressure chambers 28 are defined by diaphragm plate 20, pressure chamber inlet separator plate 32 (FIG. 5), and walls 27 (one identified in each of arrays 30) defined by plate 22. Plate 22 also has nine mounting tabs 29 by which print head 10 is attached to an ink source (not shown).

The transducers (not shown) selected for print head 10 can comprise piezoelectric ceramic transducers bonded with epoxy to diaphragm plate 20, with each of the transducers centered over a respective one of pressure chambers 28.

The piezoelectric ceramic transducers have metal film layers (not shown) to which an electronic circuit driver (not shown) is electrically connected. Each transducer is operated in bending mode such that, when a voltage is applied across its metal film layers, it attempts to change its dimensions. However, because it is securely and rigidly attached to diaphragm plate 20, the transducer bends and thereby displaces ink in the one of pressure chambers 28 with which it is in alignment. That displacement causes outward flow of ink through one of outlet channels 40 (FIGS. 4–12) to one of nozzles 88 (FIG. 13). Filling of pressure chamber 28 with ink is augmented by reverse bending of the transducer.

The four separate fluid pathways through print head 10 have identical structure downstream of volumes 24. The following discussion of those pathways accordingly describes only the pathway for black ink, which leads from volume 24K.

Figure 5:
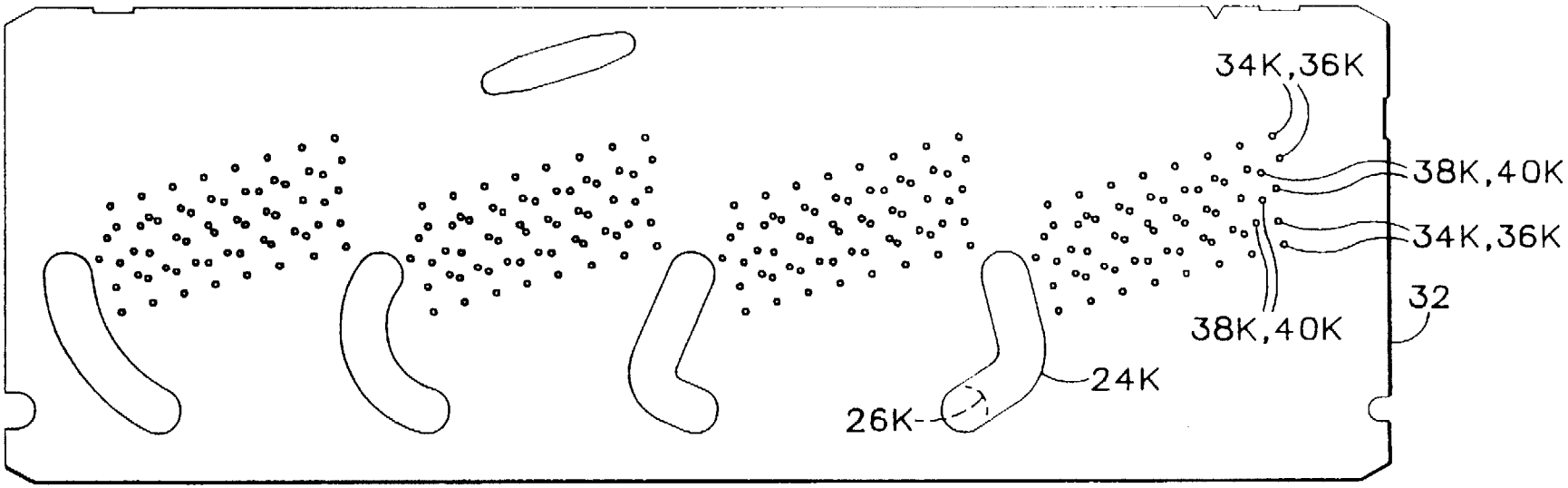
FIG. 5 is an enlarged view of a pressure chamber inlet separator plate shown in FIG. 1

FIG. 5 is an enlarged view of pressure chamber inlet separator plate 32, which defines a further part of volume 24K and portion 26K. Plate 32 also defines an opening part 34K of multiple inlet channels 36K, each aligned with and leading to a respective one of pressure chambers 28 when plates 22 and 32 are in registration. Opening parts 34K are arranged in an upper group of two rows of eight each and a lower group of two rows of seven and eight. The upper group leads to the upper two rows of pressure chambers 28 in each array 30; the lower group leads to the lower two rows of pressure chambers 28 in each array 30. One opening part 34K is identified for each of those rows. Plate 32 further defines a first part 38K of multiple outlet channels 40K, each aligned with and leading from a respective one of pressure chambers 28 when plates 22 and 32 are in registration. First parts 38K are arranged in an upper group of two rows of eight each and a lower group of two rows of seven and eight. The upper group leads from the upper two rows of pressure chambers 28 in array 30K; the lower group leads to the lower two rows of pressure chambers 28 in array 30K. One first part 38K is identified for each of those rows.

Opening parts 34K of inlet channels 36K are preferably located diametrically opposite across pressure chambers 28 from first parts 38K of outlet channels 40K. Such diametric opposition promotes cross-flushing of pressure chambers 28 during filling and purging to facilitate sweeping any bubbles from pressure chambers 28. Such diametric opposition also provides the largest separation across pressure chamber 28 between the inlet channel 36K and the outlet channel 40K of that pressure chamber 28, an arrangement that enhances acoustic isolation between those channels.

Figure 6:
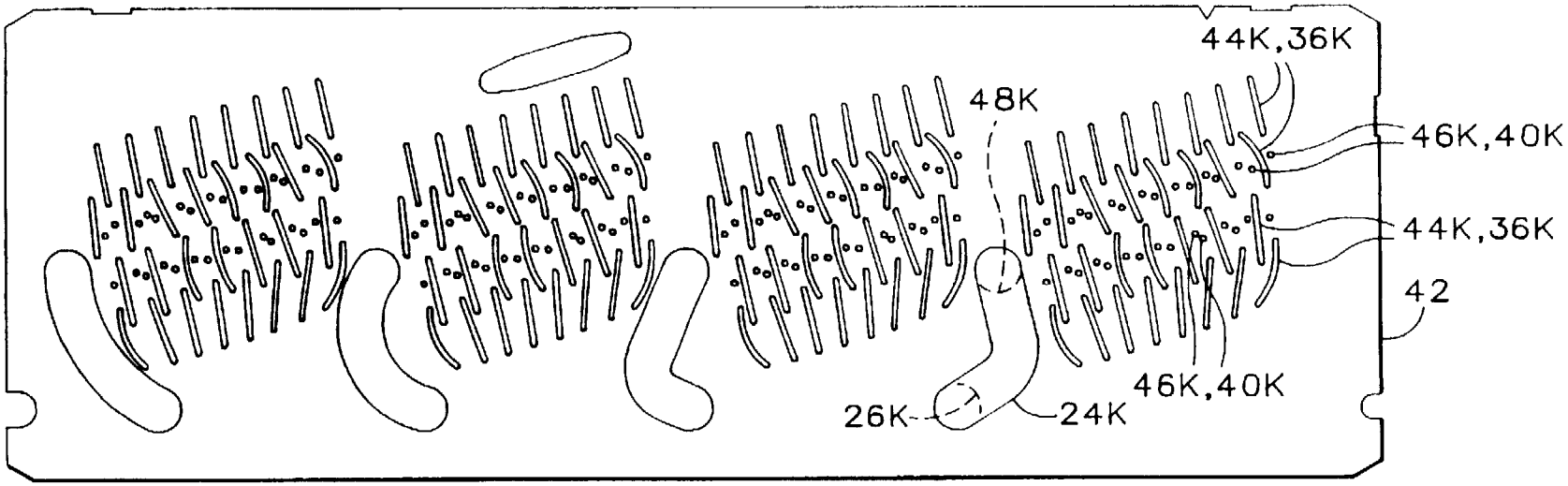
FIG. 6 is an enlarged view of an inlet plate shown in FIG. 1.

FIG. 6 is an enlarged view of inlet plate 42, which further defines part of volume 24K and portion 26K. Plate 42 also defines transverse parts 44K of inlet channels 36K, each of which is aligned with and leads to a respective one of opening parts 34K (plate 32, FIG. 5) when plates 32 and 42 are in registration.

Transverse parts 44K are provided in four groups, each associated with a respective one of the four groups of rows of opening parts 34K of inlet channels 36K of plate 32 (FIG. 5); thus, the four groups of transverse parts 44K include 8, 8, 7, and 8 transverse parts 44K, respectively. One transverse part 44K is identified for each of those rows. Although the groups of transverse parts 44K have slightly different configuration, all transverse parts 44K are designed to have the same fluid resistance, capacitance, and inductance, and have the same length and cross-sectional dimensions.

Plate 42 further defines multiple second parts 46K of outlet channels 40K; each of second parts 46K is in alignment with and leading from a respective one of first parts 38K (plate 32 (FIG. 5)) of outlet channels 40K when plates 32 and 42 are in registration. Second parts 46K are provided in four groups, each associated with a respective one of the groups of first parts 38K of outlet channels 40K of plate 32 (FIG. 5); thus, the four groups of second parts 46K include 8, 8, 7, and 8 transverse parts 46K, respectively. One second part 44K is identified for each of those rows. Volume 24K, defined by plates 22, 32, and 42, has a portion 48K, shown only in connection with plate 42 but of identical cross-section in plates 22 and 32.

Figure 7:
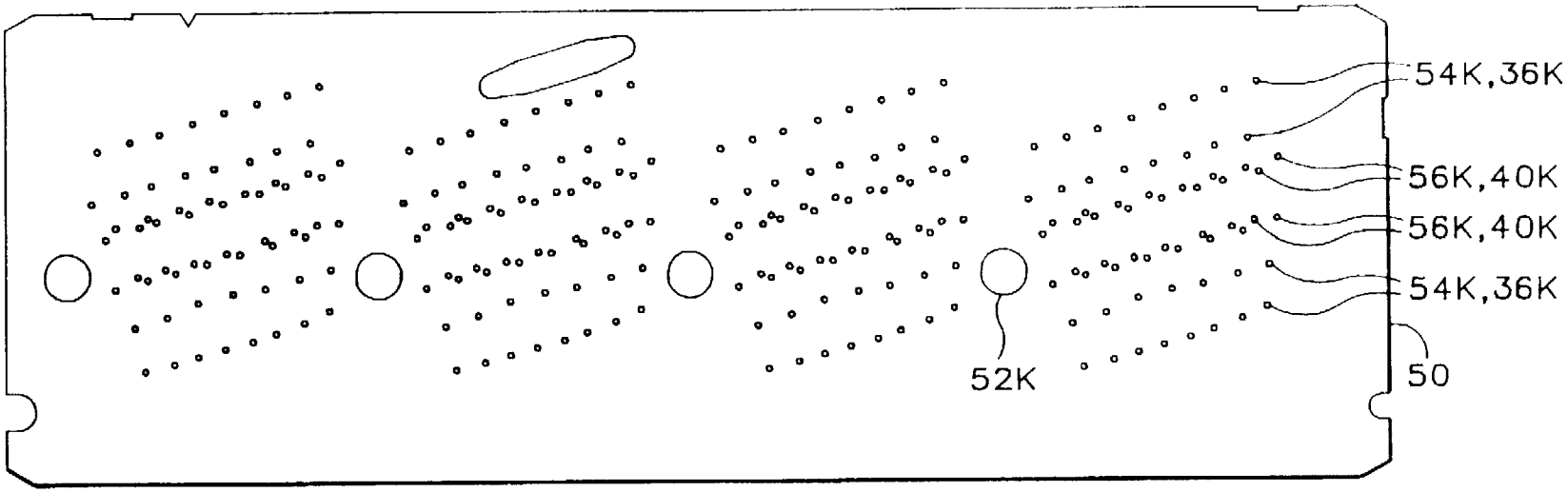
FIG. 7 is an enlarged view of a manifold/inlet separator plate shown in FIG. 1.

FIG. 7 is an enlarged view of manifold/inlet separator plate 50, which defines a part of supply channel 52K. Portion 48K (plate 42) of volume 24K is in alignment with and leads to supply channel 52K when plates 42 and 50 are in registration. Plate 50 also defines multiple connecting parts 54K of inlet channels 36K. Each connecting part 54K is in alignment with and leads to a respective one of transverse parts 44K (plate 42) of inlet channels 36K when plates 42 and 50 are in registration. Thus, connecting parts 54K are provided in four groups, each of which is associated with a respective one of the four groups of transverse parts 44K (plate 42); the four groups of connecting parts 54K thus include 8, 8, 7, and 8 of connecting parts 54K, respectively. One connecting part 54K is identified for each of those groups. Plate 50 also defines multiple third parts 56K of outlet channels 40K. Each of third parts 56K is in alignment with and leads to a respective one of second parts 46K (plate 42) of outlet channels 40K when plates 42 and 50 are in registration. Thus, third parts 56K are provided in four groups, each of which is associated with a respective one of the four groups of second parts 46K (plate 42); the four groups of third parts 56K thus include 8, 8, 7, and 8 third parts 56K, respectively. One third part 56K is identified for each of those groups.

Figure 8:
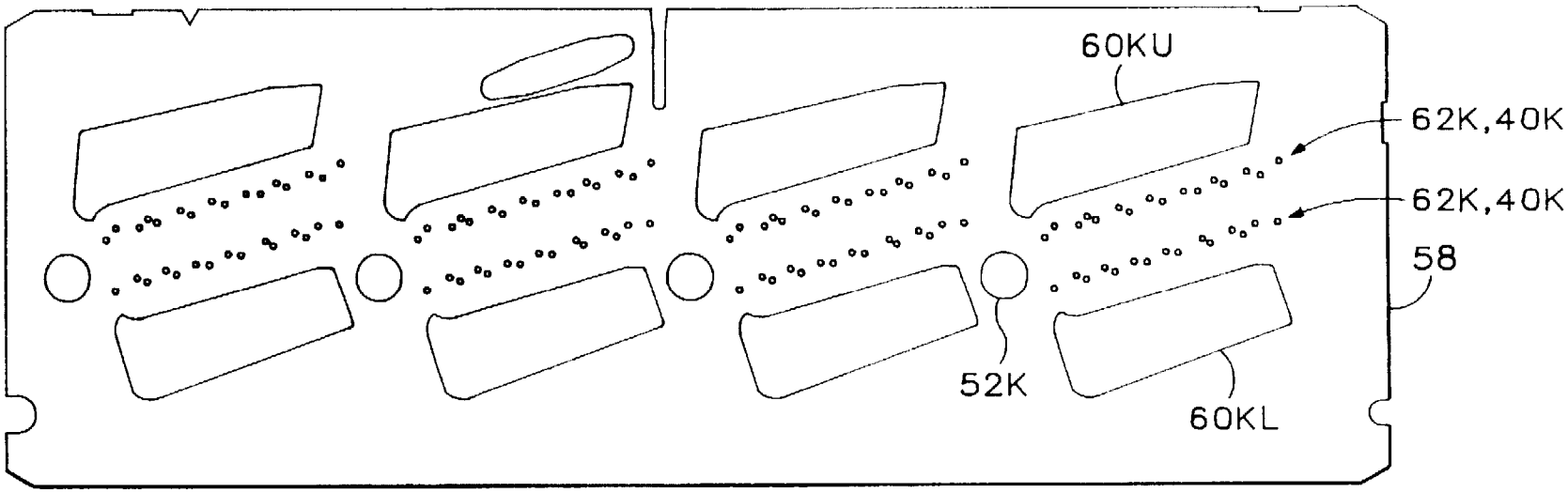
FIG. 8 is an enlarged view of a blocked manifold/inlet front separator plate shown in FIG. 1.

FIG. 8 is an enlarged view of blocked manifold/inlet front separator plate 58. Plate 58 defines a further part of supply channel 52K. Plate 58 also defines in part upper manifold 60KU and lower manifold 60KL. When plates 50 (FIG. 7) and 58 are in registration, (a) parts of upper manifold 60KU are in alignment with and lead to each of the upper two groups of connecting parts 54K of inlet channels 36; (b) parts of lower manifold 60KL are in alignment with and lead to each of the lower two groups of connecting parts 54K of inlet channels 36. Plate 58 further defines fourth parts 62K of outlet channels 40K, which are in alignment with and lead to respective ones of third parts 56K of outlet channels 40K when plates 50 and 58 are in registration. Thus, fourth parts 62K are provided in four groups, each of which is associated with a respective one of the four groups of third parts 56K (plate 50, FIG. 7); the four groups of fourth parts 62K thus include 8, 8, 7, and 8 fourth parts 62K, respectively.

When print head 10 is assembled, connecting parts 54 (plate 50, FIG. 7) are distributed through manifolds 60 in a staggered manner, with about one-quarter (i.e., those from the topmost group of 8) of connecting parts 54K adjacent to the upper side of upper manifold 60KU, about one-quarter (i.e., those from the group of 8 second from the top) of them adjacent to the lower side of upper manifold 60KU, about one-quarter (i.e., the group of 7) of them adjacent to the top of lower manifold 60KL, and the remaining about one-quarter of them adjacent the lower side of manifold 60KL. Manifolds 60KU and 60KL are tapered and are arranged to slope in a generally elevationally upward direction as described in the copending application to promote purging.

Figure 9:
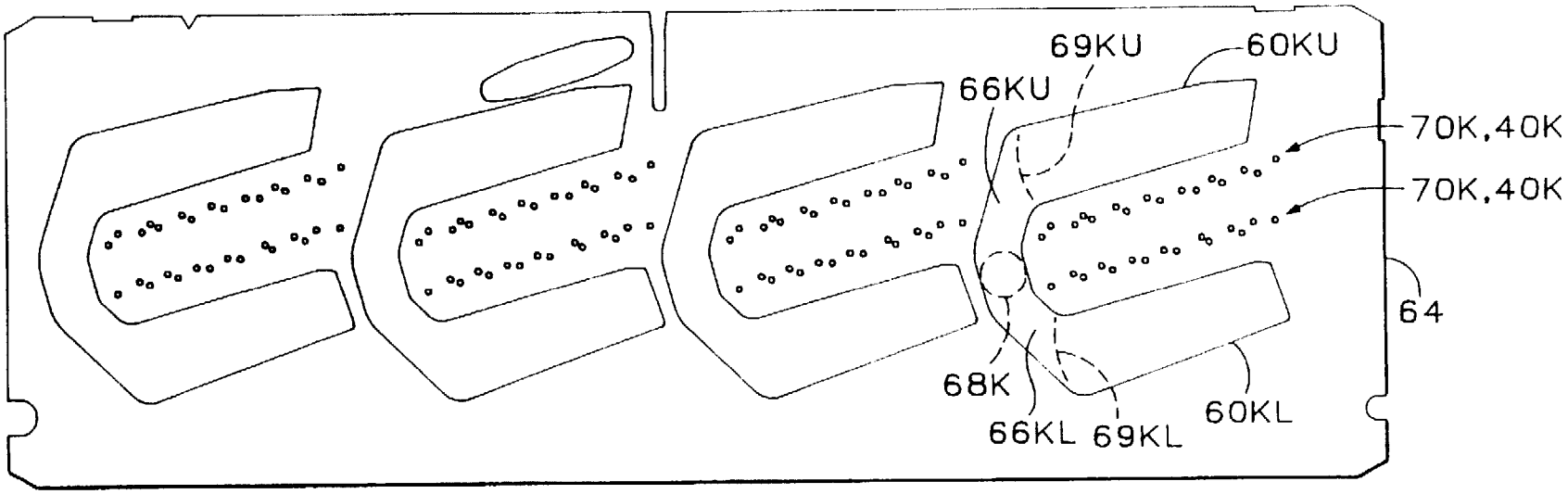
FIG. 9 is an enlarged view of an open manifold/inlet front separator plate shown in FIG. 1.

FIG. 9 is an enlarged view of open manifold/inlet front separator plate 64, which further defines parts of upper manifold 60KU and lower manifold 60KL. Plate 64 also defines one of open portions 66U and 66L (see FIG. 17) connecting upper manifold 60KU and lower manifold 60KL, respectively, with supply channel 52. Open portions 66KU and 66KL connect to a portion 68K of the same dimensions as supply channel 52K (plates 50 (FIG. 7) and 58 (FIG. 8)). When plates 58 and 64 are in registration, supply channel 52K is in alignment with and leads to portion 68K. Lines 69KU and 69KL show the location in plates 58 (FIG. 8) and 72 (FIG. 10) of the upstream edge of respective upper manifold 60KU and lower manifold 60KL. Plate 64 also defines fifth parts 70K of outlet channels 40K. When plates 58 and 64 are in registration, each of fourth parts 62K of outlet channels 40K is in alignment with and leads to a respective one of fifth parts 70K. Thus, fifth parts 70K are provided in four groups, each of which is associated with a respective one of the four groups of fourth parts 62K (plate 58); the four groups of fifth parts 70K thus include 8, 8, 7, and 8 fifth parts 70K, respectively.

Figure 10:
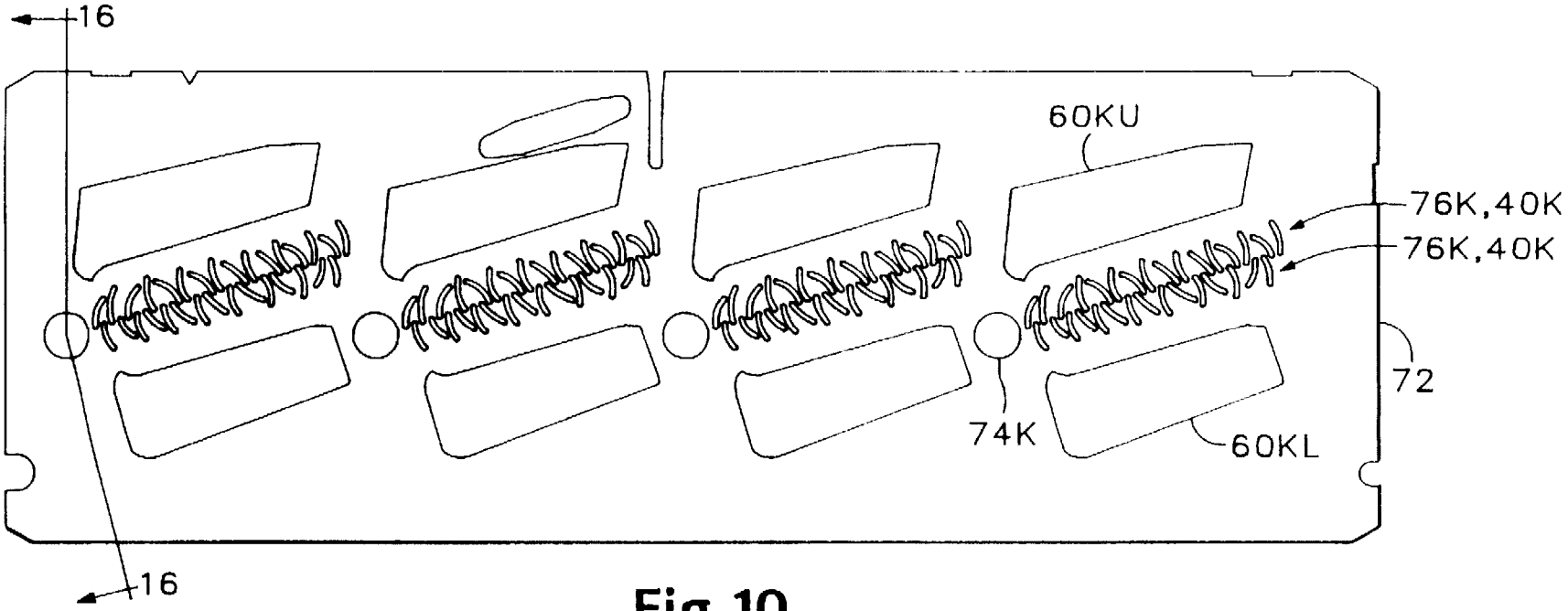
FIG. 10 is an enlarged view of a blocked manifold plate shown in FIG. 1.

FIG. 10 is an enlarged view of blocked manifold plate 72, which defines a further part of upper manifold 60KU and lower manifold 60KL. Plate 72 further defines opening 74K that is of the same size as supply channel 52K (plates 50 and 58) and that is in alignment with and leads to portion 68K (plate 64) when plates 64 and 72 are in registration. Plate 72 also defines part of multiple outlet volumes 76K of ink outlet channels 40K, each of which is in alignment with and leads to a respective one of portions 70K (plate 64, FIG. 9) of ink outlet channel 40K when plates 64 and 72 are in registration. Thus, outlet volumes 76K are provided in four groups, each of which is associated with a respective one of the four groups of fifth parts 70K (plate 64); the four groups of outlet volumes 76K thus include 8, 8, 7, and 8 outlet volumes 76K, respectively.

Figure 11:
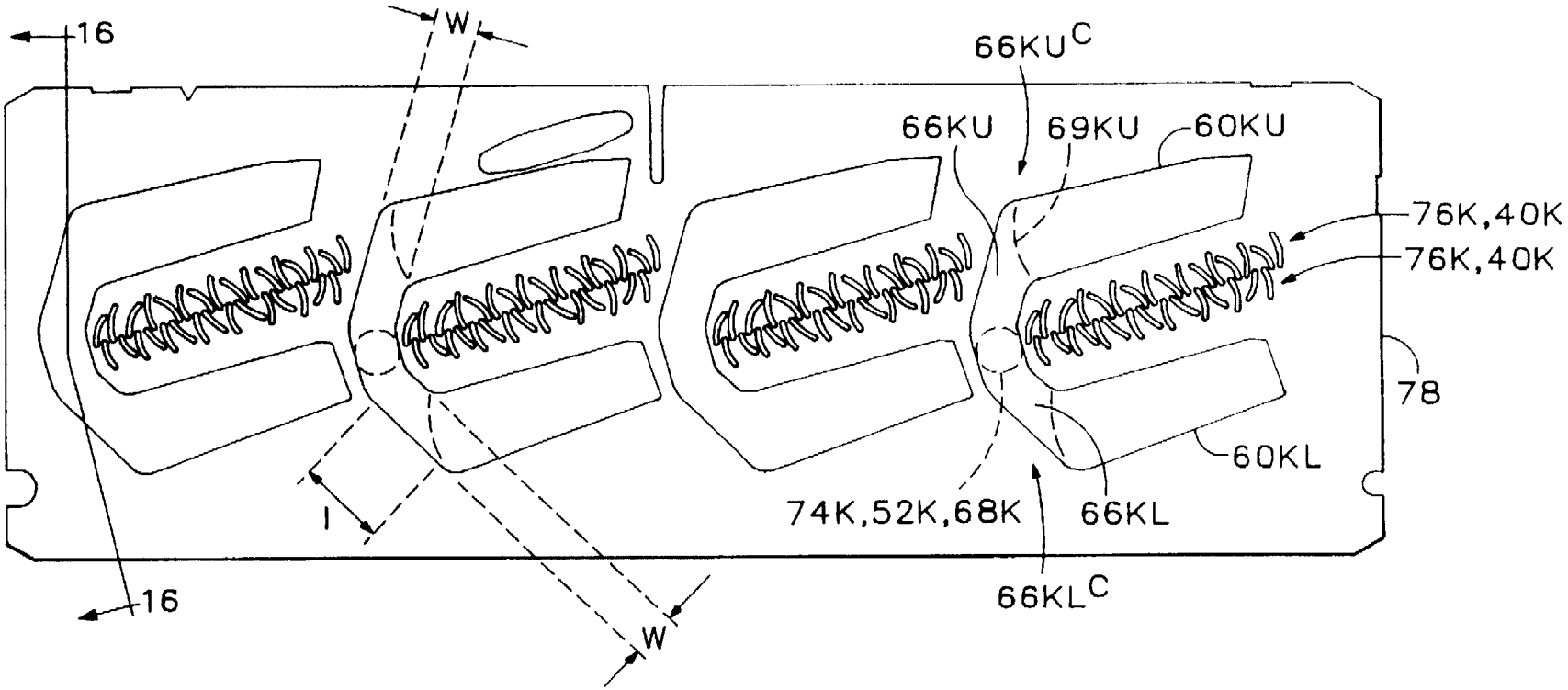
FIG. 11 is an enlarged view of an open manifold plate shown in FIG. 1.

FIG. 11 is an enlarged view of open manifold plate 78, which defines parts of upper manifold 60KU, lower manifold 60KL, portion 68K, and open portions 66KU and 66KL of cross-sectional dimension identical to the cross-sectional dimension of those parts as defined by plate 64 (FIG. 9). Plate 78 further defines parts of multiple ink outlet volumes 76K, each of which is identical with the part of those volumes defined by blocked manifold plate 72. When plates 58, 64, 72, and 78 are in registration, manifolds 60K lead smoothly from plate 64 to plate 74. When plates 72 and 78 are in registration, outlet volumes 76K lead smoothly from plate 72 to plate 78.

In FIG. 11 lines 52K show the location in adjacent plates of supply channel 52K, which opens to each of manifolds 60 through open manifold plates 64 and 78, and line 68K shows the location of portion 68K (FIG. 9), which aligns with supply channel 52K, and line 74K shows the location of opening 74K (plate 72, FIG. 10). Lines 69KU show the location in adjacent plates of the upstream edge of upper manifold 60KU; lines 69KL show the location in adjacent plates of the upstream edge of lower manifold 60KL. Portions 66KU and 66KL (also FIGS. 14–15) lie between lines 52 and lines 69KU and 69KL, respectively, that are open in an open manifold plate such as plates 64 and 78 but closed in closed manifold plates such as plates 58 and 72. Liquid ink can flow from supply channels 52 into upper and lower manifolds 60 only through the separate portions 66. The fluid passageway regions 66KU and 66KL from supply channel 52 to respective upper and lower portions of the manifold have an average width X in the curved portions $66KU^c$ and $66KL^c$ of those respective regions. FIG. 11 illustrates X shown as the distance w in FIG. 11 only in the narrowest part of those regions. Those regions have a length Z shown as distance 1 in FIG. 11, measured from the edge of supply channel 52 to the closest respective edge of manifolds 60KU and 60KL.

As shown in FIG. 1, three blocked manifold plates 72 and two open manifold plates 78 are used to make print head 10. Thus, when those plates are in registration in the order shown in FIG. 1, (a) manifolds 60K lead smoothly from plate 58, plate 64, the first plate 72, the first plate 78, the second plate 72, the second plate 78, and the third plate 72; (b) supply channels 52K lead smoothly through portions 68 and openings 74 from plate 58 through the third plate 72; (c) outlet volumes 76K lead smoothly from the first plate 72 through the third plate 72.

Figure 12:
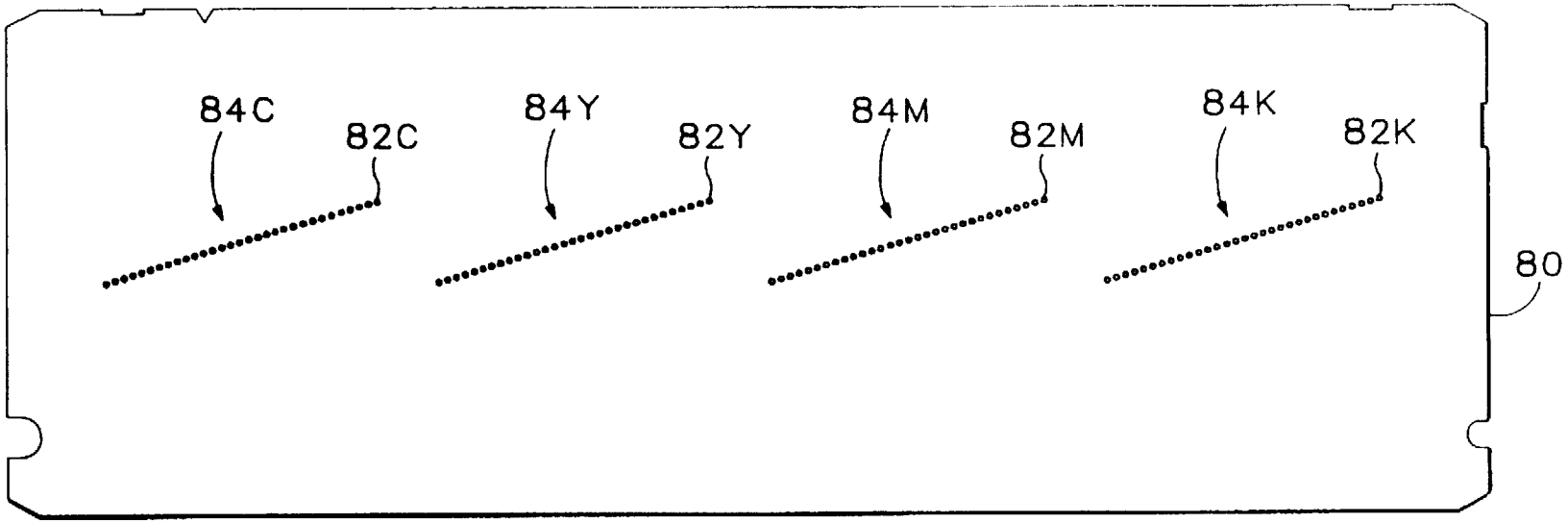
FIG. 12 is an enlarged view of an orifice/manifold separator plate shown in FIG. 1.
Figure 13:
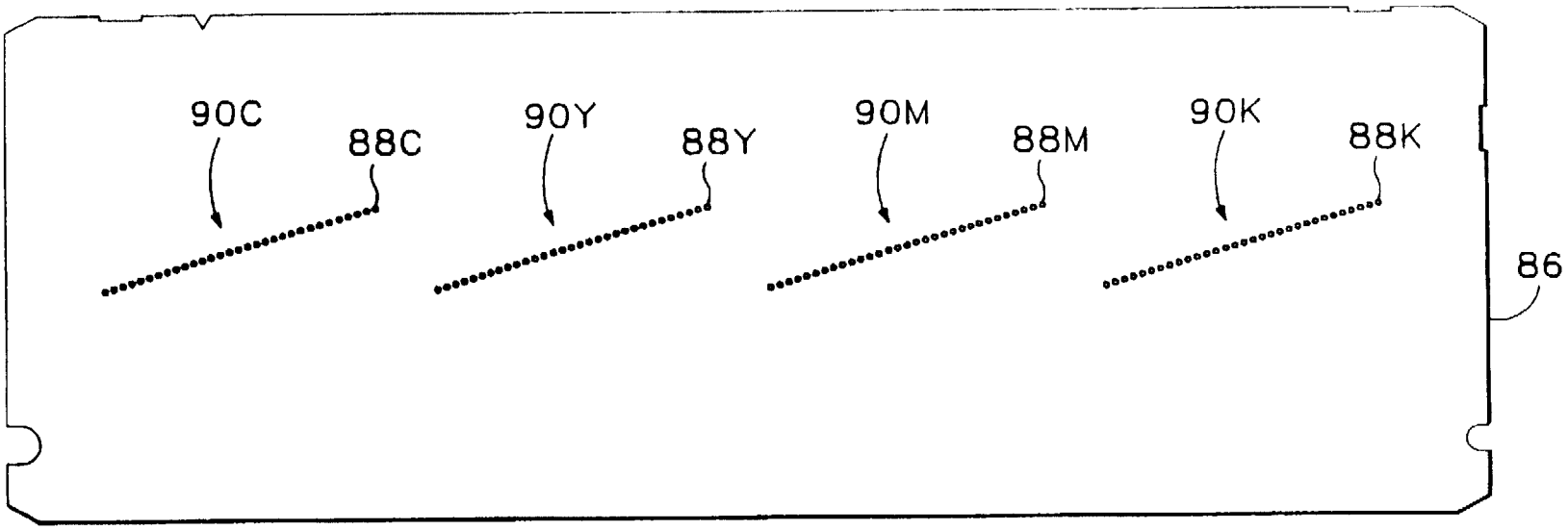
FIG. 13 is an enlarged view of an orifice plate shown in FIG. 1.

FIG. 12 is an enlarged view of orifice/manifold separator plate 80, which defines 31 separator openings 82 in each of four arrays 84K, 84M, 84Y, and 84C. When plates 78 (FIG.

11) and 80 are in registration, each of the separator openings 82K is aligned with and leads to a respective one of outlet volumes 76K.

FIG. 13 is an enlarged view of orifice plate 86, which defines 31 nozzles 88 in each of four arrays 90K, 90M, 90Y, and 90C. When plates 80 and 86 are in registration, each of nozzles 88K is aligned with and leads to a respective one of separator openings 82K (plate 80). When print head 10 is placed in operation, nozzles 88K direct droplets of liquid ink through the air at a medium (not shown) such as a piece of paper.

Representative thicknesses of the plates shown in FIGS. 1—13 are as follows:

TABLE A

Thicknesses of Plates Shown in FIGS. 1–13

| Plate | Thickness (mm) | Thickness (inches) |
|---|---|---|
| 12 | 0.15 | 0.006 |
| 20 | 0.1 | 0.004 |
| 22 | 0.2 | 0.008 |
| 32 | 0.2 | 0.008 |
| 42 | 0.2 | 0.008 |
| 50 | 0.2 | 0.008 |
| 58 | 0.2 | 0.008 |
| 64 | 0.2 | 0.008 |
| 72 | 0.2 | 0.008 |
| 78 | 0.2 | 0.008 |
| 86 | 0.2 | 0.008 |
| 92 | 0.08 | 0.003 |

Skilled persons will appreciate that other thicknesses and other relations of thicknesses could be used. As an example, plates 58 and 72 need not have the same thickness as plates 64 and 78.

When print head 10 is operated, ink is supplied from an ink source (not shown) through supply openings 14, volumes 24, and supply channels 52 to manifolds 60. A drive signal source (not shown) selectively drives the transducers (not shown), which causes liquid ink of each of the four colors to be drawn from the ink source (not shown) into print head 10 as a result of pressure drop in the fluid openings in print head 10 due to expulsion of liquid ink from nozzles 88 that print ink of that color. The ink flows through the one of supply openings 14K, 14C, 14Y, and 14M appropriate for that color, into the one of the volumes 24K, 24C, 24Y, and 24M appropriate for that color, and through the one of the supply channels 52K, 52C, 52Y, and 52M appropriate for that color. From that supply channel the ink flows into the upper and lower manifolds of the one of the manifolds 60K, 60C, 60Y, and 60M appropriate for that color; that flow occurs in the flow regions 66 defined by one or more of open manifold plates 64 and 78. Once in the upper and lower manifolds, the liquid ink is drawn into one or more of the inlet channels 36 and thence to the respective pressure chambers 28 to which inlet channels 36 lead. When that pressure chamber fires, the ink is impelled into the outlet channel 40 associated with that pressure chamber 28 toward and eventually out of the nozzle 88 associated with that pressure chamber.

Figure 14:
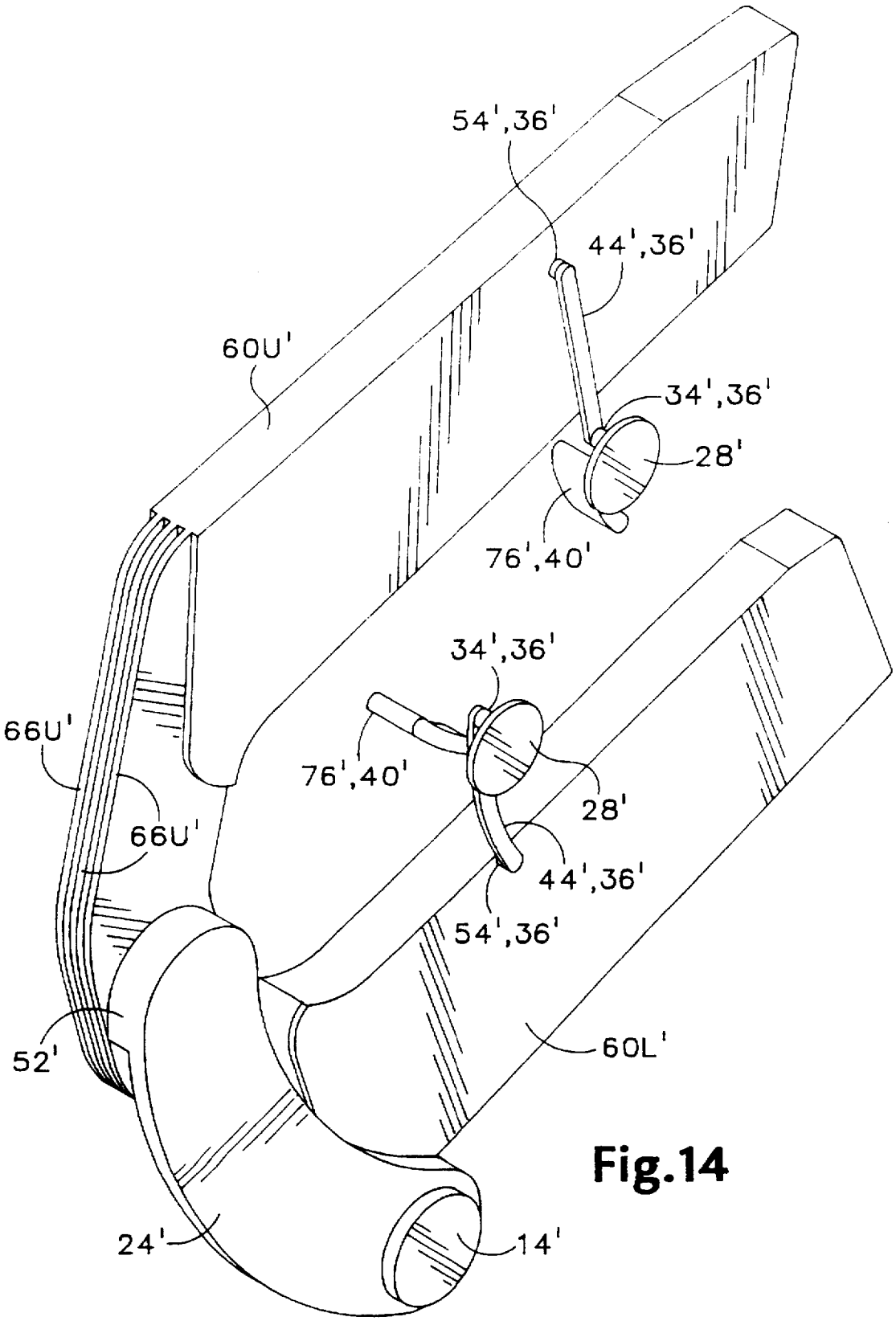
FIG. 14 is an isometric view, taken from the side to which the supply channel connects, of the volumes occupied by liquid ink in one of the ink pathways in a print head formed by assembling the plates shown in FIGS. 1–13.

FIG. 14 is an isometric view, taken from the side to which supply openings 14 connect, of volumes occupied by liquid ink in print head 10, showing liquid ink in only one ink inlet 36 and one ink outlet 40 from each of upper and lower manifolds 60U and 60L to respective nozzle 88. The view of FIG. 14 is representative for present purposes of part of any of the four ink pathways; thus, color suffixes are omitted in FIG. 14.

Figure 15:
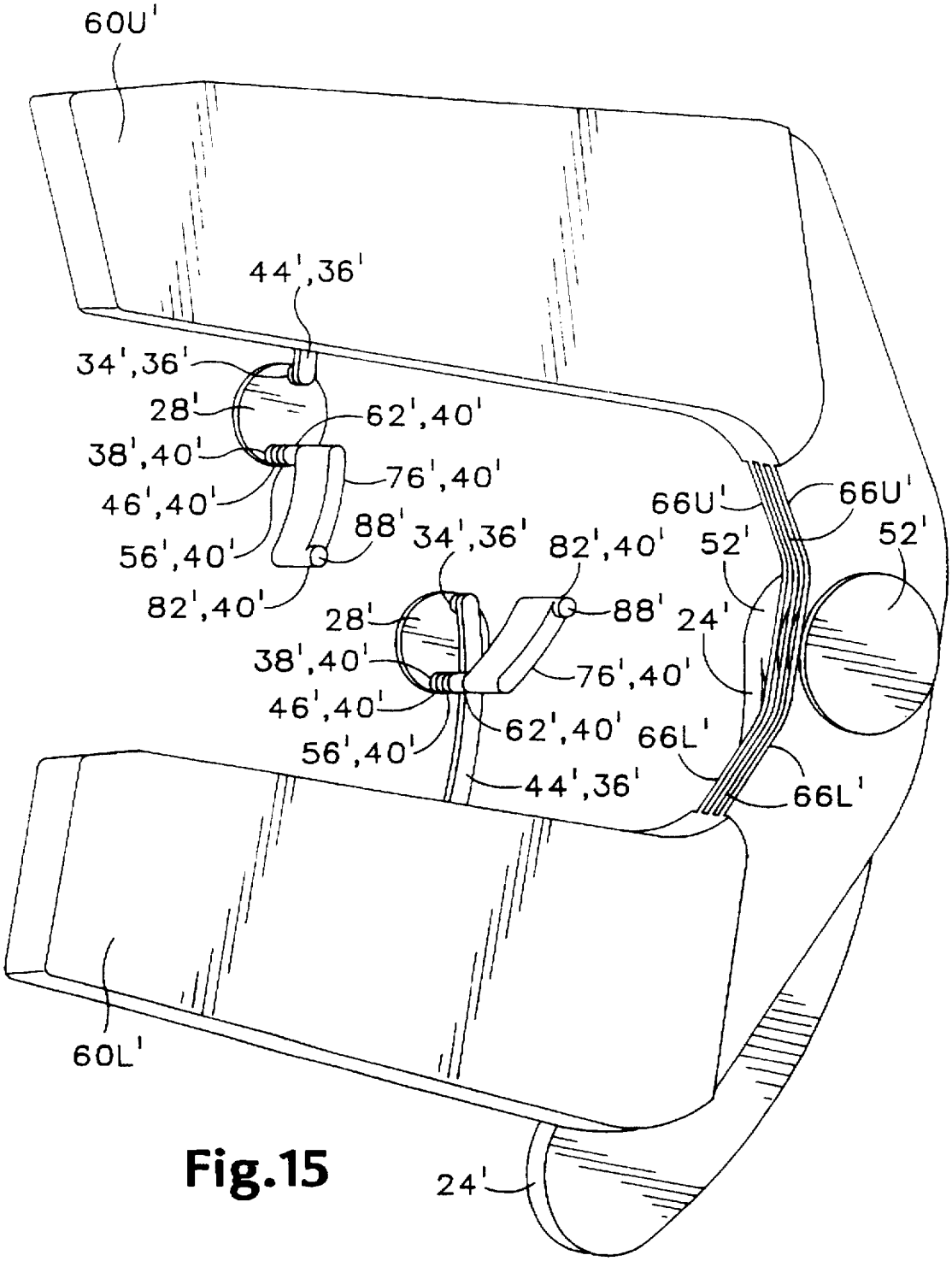
FIG. 15 is an isometric view, taken from the side to which liquid ink is ejected, of the volumes occupied by liquid ink as shown in FIG. 14.

FIG. 15 is an isometric view of the same ink volumes as FIG. 14, shown from the side to which liquid ink is ejected from print head 10. In FIGS. 14 and 15 a prime following a reference numeral indicates liquid ink contained in that part of the pathway defined by print head 10 and identified by that unprimed reference numeral in FIGS. 1–13.

With reference to FIGS. 1–15, ink 14' flows from an ink source (not shown) in through supply openings 14. Ink 24' occupies volumes 24, and ink 52' occupies supply channels 52. Ink 66U' and 66L' occupies respective open portions 66U and 66L defined by plate 64 and the two plates 78. Ink 60U' and 60L' occupies respective upper and lower manifolds 60U and 60L defined by plates 58, 64, the three plates 72, and the two plates 78.

Ink fills inlet channels 36 from the manifolds 60 to the pressure chambers 28 as follows: ink 54' occupies connecting parts 54 leading from manifolds 60U and 60L; ink 44' occupies transverse parts 44 leading from connecting parts 54; ink 34' occupies opening parts 34 leading from transverse parts 44 to pressure chambers 28; ink 28' occupies pressure chambers 28.

Ink fills outlet channels 40 from pressure chambers 28 to orifices 94 as follows: ink 38' occupies first parts 38 leading from pressure chambers 28; ink 46' occupies second parts 46 leading from first parts 38; ink 56' occupies third parts 56 leading from second parts 46; ink 62' occupies fourth parts 62 leading from third parts 56; ink 76' occupies outlet volumes 76 leading from fourth parts 62; ink 82' occupies separator openings 82 leading from outlet volumes 76; and ink 88' occupies nozzles 88 leading from separator openings 82.

As best shown in FIG. 15, the cross-sectional area of ink outlet channels 40 decreases from separator openings 82 to nozzles 94 in outlet channel 40.

As also best shown in FIG. 15, the cross-sectional area also progressively decreases in the direction of ink flow from pressure chambers 28 to first part 38 (defined by plate 32 (FIG. 5)), second part 46 (defined by plate 42 (FIG. 6)), third part 56 (defined by plate 50 (FIG. 7)), and fourth part 62 (defined by plate 58 (FIG. 8)) of outlet channel 40. For the reasons described in the co-pending application, the cross-sectional area becomes progressively smaller in the direction of flow.

As described in the co-pending application, manifolds 60 are tapered. Tapered manifolds 60 contribute to reducing jetting non-uniformity because they can be designed to have a natural resonant frequency above the maximum jetting frequency of the print head. An untapered manifold having the same volume as a tapered manifold tends to have a lower resonant frequency than the tapered manifold, and that lower resonant frequency is often unacceptably close to the maximum jetting frequency.

However, as also described in the co-pending application, tapering the manifolds appears to increase both steady-state pressure loss and the transient pressure fluctuation in the manifolds. Increasing the volume of a manifold to decrease the pressure loss and the fluctuation also decreases the natural resonant frequency of the manifold. Therefore, when designing a manifold before the present invention, it was necessary to balance a tolerable amount of steady-state pressure loss and transient pressure fluctuation against achieving a sufficiently high natural resonant frequency.

The conflicts just described were difficult to resolve using only the techniques discussed in the co-pending application. However, the increased jetting uniformity brought about by a tapered manifold can be further improved by coupling baffles to each of manifold 60U and 60L by interposing baffles between each of manifolds 60U and 60L and opening 52, volume 24, and opening 14.

Figure 16:
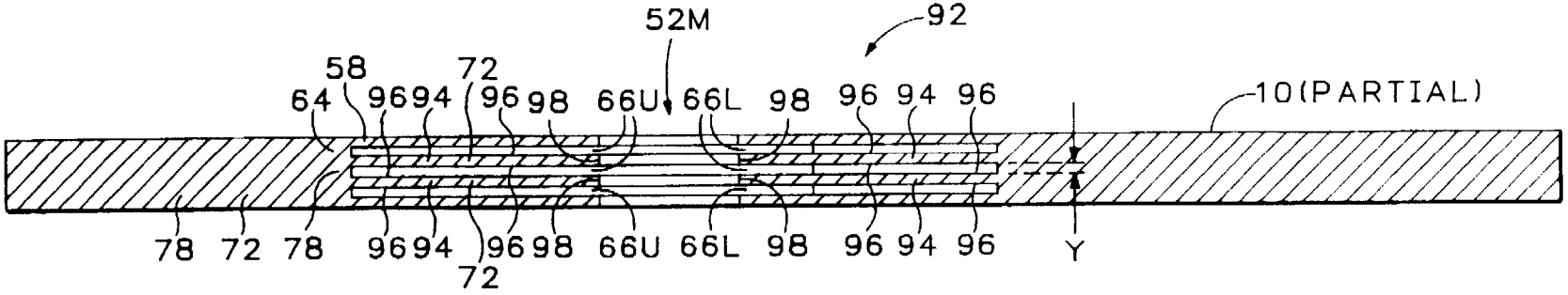
FIG. 16 is a simplified cross-sectional view of a completed assembly of alternate blocked and open manifold plates, taken along the lines 16—16 of FIGS. 10 and 11.

When the plates shown in FIGS. 1–13 are placed in registration and brazed together to form print head 10, the alternation of plates with open and closed manifolds produces a damping or baffle structure between supply channels 52 and upper and lower manifolds 60U and 60L. FIG. 16 is a simplified cross-sectional view of part of print head 10 that includes a completed assembly of plates 58, 64, 72, 78, 72, 78, and 72 having alternately closed and open manifolds, taken along lines 16—16 of FIGS. 10 and 11. The simplified view of FIG. 16 excludes other plates of print head 10. When plates 58, 64, 72, 78, 72, 78, and 72 are brazed together as part of print head 10, those plates are no longer mechanically separate; however, in FIG. 16 the portions of print head 10 stemming from those plates are identified by the respective reference numerals of those plates. Blocked manifold plates 58 and 72 define a damping structure or baffle structure 92 having two baffles 94 (formed by two plates 72). Baffle structure 92 defines the three fluid passageways 66U and 66L (FIGS. 14–15) that provide separate fluid passageways from supply channel 52 to respective manifolds 60U and 60L. Each of fluid passageways 66U and 66L has a thickness Y. Each baffle has a major surface 96 oriented parallel to the direction of ink flow from supply channel 52 to manifolds 60U and 60L and a minor surface 98.

The plates from which print head 10 is formed are formed so that the fluid aspect ratio w/h (FIGS. 11 and 18) of open fluid passageways 66U and 66L is large, e.g., preferably greater than five (5), and more preferably about ten (10). Such a large fluid aspect ratio provides a steep gradient of fluid velocity from the wall of each blocked manifold plate (such as plate 72) to the center of a fluid passageway (such as passageway 66U) and from that center to the wall of the other adjacent blocked manifold plate (such as plate 72).

The plates are also formed so that the length l of fluid passageways 66U and 66L is sufficiently long that the steep gradient of fluid velocity extends over a sufficiently large surface area exposed to the ink to transfer sufficient momentum from the ink to the walls defining passageways 66U and 66L to damp the acoustic waves to an acceptable level. That factor can be characterized by the ratio of the total surface area $A_s$ exposed to ink in passageways 66U and 66L to the total open flow cross-sectional area Ac exposed to the fluid. $A_c$ is related to w and $h_i$ by the equation $$A_c = wh_iN_c$$

where $N_c$ is the number of channels or fluid passageways 66U or 66L. AS is related to w and $h_i$ by the equation $A_s = 2(w+h_i)lN_c \approx 2wlN_c$ where l is the length of the channels 66U and 66L and the approximate equality follows because, under the conditions given for w and $h_i$, $w >> h_i$. The ratio of $A_s$ to $A_c$ thus is $$A_s/A_c \approx \frac{2l}{h_i}$$

and should be made sufficiently large. Because l is constrained by other practical considerations in the design of print head 10, this relation also calls for $h_i$ to be small.

The shear stress across an open portion 66U or 66L, and thus the rate of momentum transfer, depends on the viscosity μ (mu) of the ink, as well as the channel geometry and flow rate. For light-transmissive phase-change inks of the type used in print head 10, $h_i$ is preferably about 0.5 mm (0.020 inch) or less and more preferably about 0.2 mm (0.008 inch). Selecting h at such a value also improves the purging performance of print head 10. Although large bubbles in ink in print head 10 will tend to flow up through and away from passageways 66U and 66L, small bubbles can become entrained in a region of stagnant ink at the downstream end of a baffle segment formed by a blocked manifold plate. By making $h_i$ sufficiently small, the size of a bubble that can become entrained in that way is reduced to a size that tends to diffuse into solution in the ink very readily. A bubble of approximately 0.2 mm (0.008 inch) will diffuse into liquid ink of the type described above almost immediately at the temperature (typically 135° C.) at which such liquid ink is held in print head 10. Bubbles of up to 0.5 mm (0.020 inch) will readily diffuse into such ink and also in to aqueous inks. Thus, the damping characteristics of baffles 94 also promote purging bubbles from print head 10.

Print head 10 is used in an ink jet printer that operates at a maximum jetting rate of about 8.5 kHz and at other jetting rates that could be, for example, ½ or ¼ of that maximum jetting rate. It is important that jetting performance be uniform at each operating rate and also between different jetting rates. Thus, acoustic pressure waves must be controlled at each of the jetting rates. Baffle structure 92 or baffles 94 must thus be adequate to achieve the desired damping at each of those frequencies.

Figure 17:
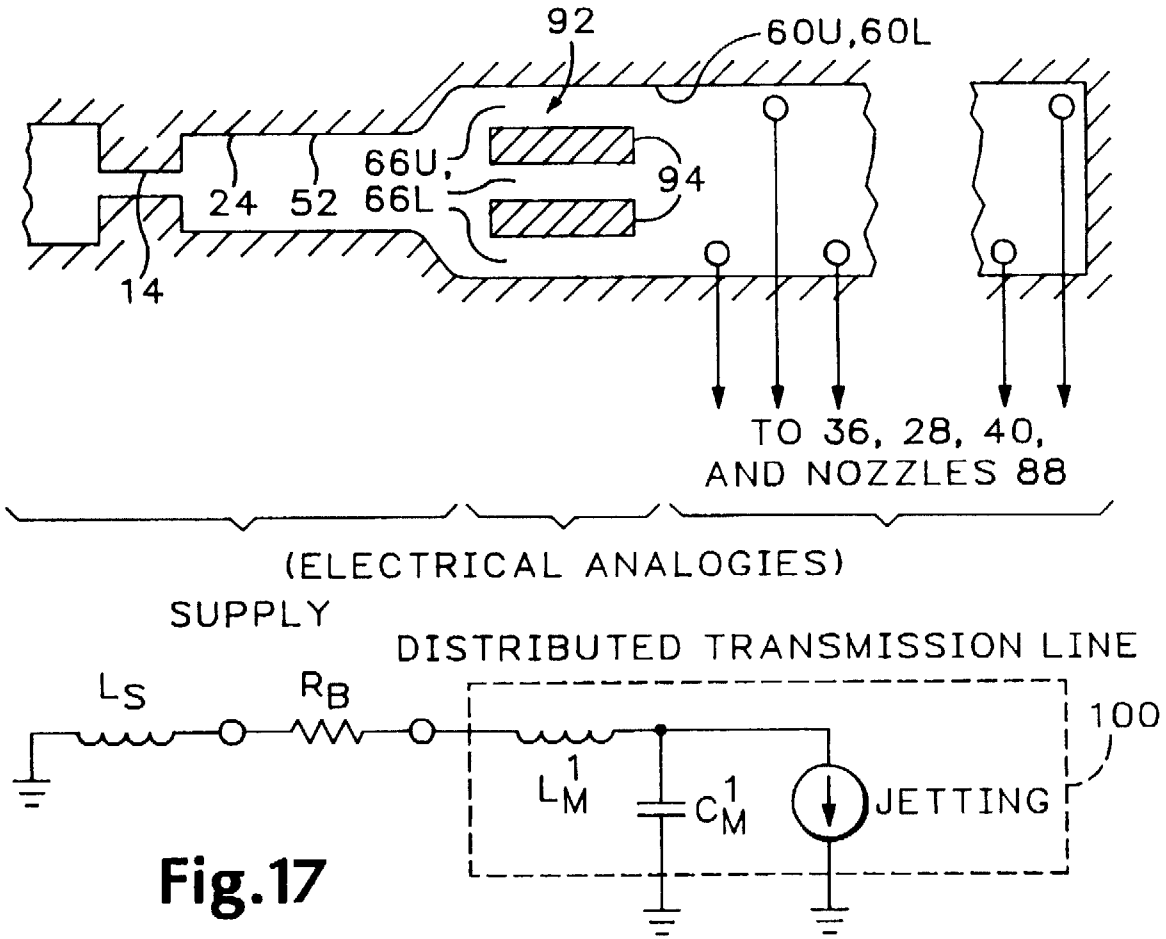
FIG. 17 is a simplified schematic diagram of certain fluidic inductances, capacitances, and resistances of a manifold terminated by baffles according to the invention.

FIG. 17 is a schematic diagram of the fluidic inductances, resistances, and capacitances of the volumes occupied by liquid ink in print head 10. Pressure waves and fluid motion or displacement waves in fluids such as liquid ink can effectively be modelled via an electrical analogy using concepts of fluid resistance, capacitance, and inductance analogized to electrical resistance, capacitance, and inductance. In such a model fluid pressure is analogous to electrical potential, and fluid flow is analogous to electrical current.

Using such a model, the fluid behavior of one of the fluid pathways through print head 10 can be represented as shown in FIG. 17. The supply passages bringing ink to baffles 94, i.e., supply opening 14, volume 24, and supply channel 22, have an equivalent combined inductance $L_s$; because they are relatively long and have a relatively constant cross-sectional area, any fluid resistance and capacitance of those elements can be neglected. Portions 66U and 66L of baffles 94 have individual fluid inductance which is also included in $L_s$ and fluid resistance $R_s$; because those portions have relatively small volume, any fluid capacitance of those portions can be neglected. Manifolds 60U and 60L have distributed fluid inductance $L'_m$ and fluid capacitance $C'_m$; because manifolds 60 are relatively wide, any fluid resistance of those manifolds can be neglected. Capacitance $C'_m$ is taken with reference to ambient pressure, i.e., pressure outside print head 10. A current drain represents the effect of discharge of ink droplets from orifices 88 coupled to each manifold. The acoustic behavior, independent of discharge of ink droplets, of the combined inlet channels 36, pressure chambers 28, and outlet channels 40 coupled to each manifold may modify the effective distributed properties of the manifold (e.g., $L'_m$ and $C'_m$) but do not alter the fundamental effect of the invention.

FIG. 17 is a schematic diagram of manifold 60U or 60L and a corresponding fluid dynamics functional schematic shown as an electrical analogy. In the electrical analogy model, baffles 94 provide a resistance $R_B$, and the manifold is represented by a distributed transmission line 100 which is terminated by the damping baffle resistance $R_B$ and by the inductance $L_s$ of the fluid supply network. Transmission line 100 has an inductance $L'_m$ and a capacitance $C'_m$ indicating respective inductance and capacitance of manifold 60U or 60L.

If baffles 94 were not present, $R_B$ would be zero. However, from transmission line theory, it is known that transmission line 100 should be terminated with a resistive load equivalent to the impedance of the transmission line itself in order to prevent unwanted reflections. In previous print head designs, such as those described in the co-pending application, only the load of the supply terminates the baffles. This load is primarily inductive (fluid mass) with little resistance and, therefore, a large part of the acoustical waves impinging on the boundary of the manifold were reflected into the manifold. The reflected waves can constructively interfere with additional waves being created by the firing of the individual jets. Standing waves are created at characteristic frequencies of the manifold. The only mechanism for damping these waves was the resistance of the jets themselves. However, to cause such damping, the manifold pressure waves must disturb the normal jetting behavior, which will adversely affect jetting uniformity.

In print head 10 baffles 94 provide the desired resistive load to terminate manifold 60U and 60L (transmission line 100). However, unlike a transmission line, the manifolds must also support an average (DC) flow. The average pressure drop caused by the average flow must be kept below a threshold so that it does not adversely affect jetting performance. Therefore, the actual resistance of baffles 94 must be a compromise between average pressure drop and acoustic impedance matching requirements. In practice, average pressure loss and purgeability requirements limit the resistance below the acoustic impedance matching value and the resistance is maximized within these constraints.

Skilled persons can readily calculate the average pressure loss caused by baffles 94 to determine if it is within acceptable limits. The parameters for this calculation are given below and the nomenclature is given in Table B which follows.

Typical parameters of the fluid ink and of each of the fluid passageways 66U and 66L, of the metal defining them, and of the flow rate of the ink within them are as follows:

Ink Fluid Properties:

ρ (rho) (fluid density)=

$$0.88\ \frac{\text{gm}}{\text{cm}^3}$$

μ (mu) (viscosity)=0.15 poise

Duct Parameters:

$h_i$=0.008 in.

w=0.110 in.

L=0.150 in.

$A_c$ (open flow cross-sectional area exposed to fluid)=$h_i w$

P (hydraulic perimeter)=$2\cdot(h_i+w)$ $D_h$ (hydraulic diameter)=

$$4\cdot A_c = \frac{0.015\ \text{in.}}{P}$$

$A_s$ (surface area exposed to fluid in passage)=P·L

Flow rate per baffle passage:

$m^d$ (mass of an individual ejected ink drop)=200 nanograms $N_j$ (number of jets drawing through either volume 66U or 66L)=16 f (jetting frequency)=9000 Hz $N_c$ (number of baffles)=3 m (mass flow rate per baffle passage)

$$=\frac{N_j f\cdot m_d}{N_c}=0.01\cdot\text{gm}\cdot\text{sec}^{-1}$$

An example of a calculation of the average pressure loss, using the variables and parameters given below and in connection with FIG. 18 and a value for the resistance per baffle passage derived from the standard laminar flow pressure loss expression, is as follows:

$$\Delta P = \frac{\rho U^2}{2}\ \frac{fL}{D_h} = \frac{\rho \dot{m}^2}{2\rho A_c^2}\ \frac{96L}{ReD_h} = \frac{\rho \dot{m}^2}{2\rho^2 A_c^2}\ \frac{96\mu L}{\rho U D_h^2}$$

$$= \frac{\rho \dot{m}^2}{2\rho^2 A_c^2}\ \frac{96\mu A_c L}{\dot{m} D_h^2} = \frac{48\mu L}{\rho A_c D_h^2}\ \dot{m} = R\cdot\dot{m}$$

$$R = \frac{48\mu L}{\rho A_c D_h^2} = 3.826\cdot 10^5\cdot\text{cm}^{-1}\cdot\text{sec}^{-1}$$

where:

$$U=\frac{\dot{m}}{\rho A_c}=1.921\cdot\text{cm}\cdot\text{sec}^{-1}$$

Using these expressions, the pressure loss Δ P=R·m=1.50 $\text{in}_{H20}$.

Baffles 94 also solve another problem that has reduced the performance of ink jet print heads. When an ink jet printer of the type described herein is turned on, liquid ink in the ink source (not shown) to which its print head is connected is maintained at a temperature of 110° C., and its print head is maintained at a temperature of 135° C. so that liquid ink printed from it will be at that temperature. However, as ink was drawn during operation into a print head of a design prior to the present invention, there was no structure to ensure that the ink would reach the higher temperature of the print head before being expelled from the nozzles. Failure to reach the higher temperature may have contributed to non-uniform jetting performance.

Ink jet operation is very dependent on ink fluid properties such as density, viscosity, compressibility, and surface tension. In phase change ink jet devices, the viscosity, in particular, is a strong function of temperature. Therefore, in order to ensure uniform jetting performance, the ink entering the many individual jets must be at a uniform temperature. Consequently, the ink temperature in manifolds 60U and 60L must be uniform and nearly equal to the jet stack structure temperature. If the ink temperature differs from the jet stack structure temperature, heat will be transferred to or from the ink as it flows along the manifold, resulting in nonuniform jetting performance.

Typical phase change ink print heads operate at 130° to 140° C. However, in order to minimize ink aging and heat loss, the ink reservoir may be maintained at a considerably lower temperature (110° C.). It is necessary, however, to ensure that the ink temperature is raised to within 1° C. or less of the jet stack structure temperature between the time it enters the port from the reservoir and the time it reaches manifolds 60U and 60L.

In order to provide good fluid dynamic performance, it is generally desirable to increase the feed and manifold sizes as the number of individual jets along the manifold is increased. However, this combination of increased flow rate and larger cross-sectional dimensions decreases the efficiency in raising ink temperature to that of the jet stack structure.

Baffles 94 have the further advantage of forming an efficient heat exchanger, warming the ink flowing past them from 110° C. to near the 135° C. temperature of print head 10. The baffle heat exchanger facilitates efficient heat transfer by providing (1) high temperature gradients due to the small passage heights and (2) large surface area due to the multiple passages. Because of these features, the baffles are able to provide the required heat exchange in the compact space available between supply channel 52 and manifolds 60U and 60L. This heat exchanger effect reflects a different physical effect than the damping effect discussed above, and it is therefore desirable to design the alternating blocked and open manifold plates so that they cause both of those effects.

Figure 18:
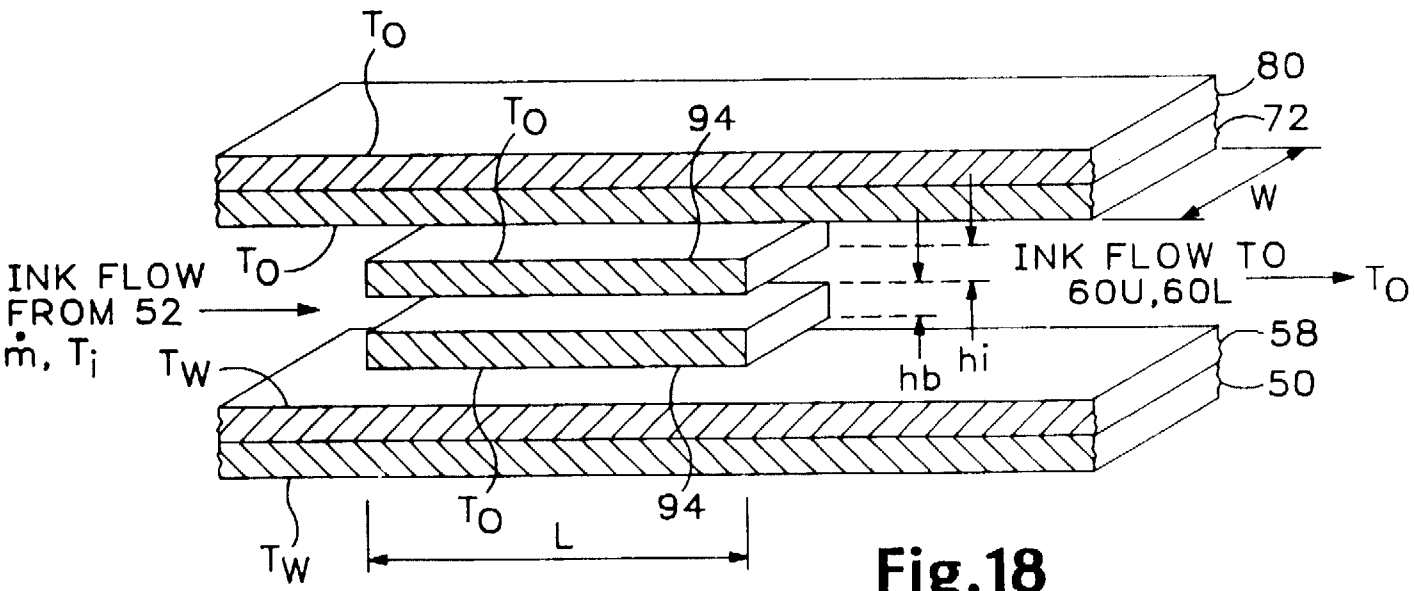
FIG. 18 is an illustrative schematic cross-sectional view of ink flow past the baffles.

FIG. 18 is an illustrative schematic cross-sectional view of ink flow past the baffles illustrating the heat exchanger function of baffles 94. Baffles 94 have a height $h_b$, and passageways 66U (or 66L) between them have a height $h_i$. Fluid passageways 66U (or 66L) convey a flow of liquid ink having an initial temperature $T_i$ and a mass flow rate $\dot{m}$ from supply channel 52 past baffles 94. Baffles 94 and plates 50, 58, 72, and 80 are held at a temperature $T_w$. Baffles 94 define passageways 66U (or 66L) with a height $h_i$, a width w, and a length 1. The fluid ink has a temperature $T_o$ as it exits the baffles.

The dimensions chosen for the fluid passageways 66U and 66L to accomplish the desired heat transfer depend on parameters of the liquid ink, on its maximum flow rate, and on the extent to which the temperature of the ink is required to approach the desired print head temperature. The temperature increase due to flow through the baffles can be calculated from principles known to skilled persons. The following calculation provides an example demonstrating that a particular combination of parameters provides adequate heat transfer to increase the ink temperature to within 1° C. of the temperature of print head 10.

TABLE B

Variables and Quantities Used in Pressure Drop and Temperature Rise Calculations $\rho$=ink density (gm/cm$^3$)
$\mu$=ink viscosity (poise)
k=ink thermal conductivity (watts/meter °C.)
$c_p$=ink heat capacity (joules/gram °C.)
$\alpha$=ink thermal diffusivity (=$k/\rho C_p$)
$h_i$=height (FIG. 18) of baffle flow passage
w=width (FIG. 18) of baffles transverse to flow direction
l=length (FIG. 18) of baffles parallel to flow direction
$A_c$=fluid passage cross-sectional area
P=fluid passage perimeter
$A_s$=fluid passage surface area
$D_h$=fluid passage hydraulic diameter
$NU_T$=Nussult number (isothermal wall)
h=convective heat transfer coefficient
$\dot{m}$=fluid passage mass flow rate
$m_d$=ink jet drop mass (nanogram/drop)
$N_j$=number of jets in manifold
f=jetting repetition rate (drops/sec)
$N_c$=number of flow passages in baffles
$T_i$=temperature of ink from supply channel
$T_o$=temperature of ink exiting baffles
$T_w$=temperature of passage walls and baffles
$\Theta$=dimensionless temperature rate ($T_w-T_o/T_w-T_i$)

The typical parameters employed in the fluid calculations have been referred to previously. The thermal parameters are given below:

Ink Thermal Properties:

$$k = 0.2\ \frac{\text{watts}}{\text{m°C.}}$$

$$c_p = 2\ \frac{\text{joule}}{\text{gm° C.}}$$

$$\alpha(\text{alpha}) = \frac{k}{\rho c_p}$$

Heat Transfer Coefficient:

$$Nu_T = 7.54$$

$$h = \frac{\mu Nu_T k}{D_h} = \frac{4000\text{joules}}{\text{m}^2\ \text{°C.}}$$

Applying standard heat transfer principles, the relationship between the initial ink temperature $T_i$ (for the preferred embodiment, 110° C.), the temperature $T_w$ of print head 10 (for the preferred embodiments, 135° C.), and the temperature $T_o$ expected to be achieved by the ink after flowing through passageways 66U and 66L is:

$$T_o=T_w+(T_i-T_w)\cdot\Theta(\text{theta}),$$

where:

$$\frac{h \cdot A_s}{m \cdot c_p} = 4.735$$

and $$\Theta = e^{\frac{-hA_s}{mc_p}} = 0.009$$

For the parameters given above, To is approximately 134.8° C., which is sufficiently close to the print head operating temperature of 135° C.

Skilled persons will recognize that various ink jet print head operating parameters depend on particular printing applications that and the parameters herein are merely those of a preferred embodiment. A wide variety of inks, maximum jet operating rates, orifice array configurations, and printer architectures exist from which skilled persons may select a best combination of variables to suit a particular printing application.

It will be apparent to skilled persons that many changes may be made to the details of the above-described embodiments of this invention without departing from the underlying principles thereof. Skilled persons will appreciate that this invention has useful applications other than in drop-on-demand ink jet recording and printing with phase-change ink. The scope of the present invention should, therefore, be determined only by the following claims.

We claim:

1. An ink jet print head having multiple printing nozzles in fluid connection with a supply channel for transporting liquid ink to the print head, comprising:

at least one group of inlet channels connected to the supply channel;

at least one group of pressure chambers, each in fluid connection with a respective one of the inlet channels and operable by action of transducers to cause discharge of liquid ink through one of the nozzles and by the action of transducers to cause the liquid ink to refill the pressure chambers;

at least one manifold in fluid connection between the supply channel and the group of inlet channels, the group of inlet channels opening on the manifold; and at least one damping structure located between the supply channel and the manifold and defining plural fluid passageways between the supply channel and the manifold, the fluid passageways having a fluid aspect ratio $w/h_i$ greater than about 5 so that $h_i$ is sufficiently small such that bubbles entrained in the ink passing through the passageways between the supply channel and the manifold are reduced in size to thereby readily diffuse into the ink to improve purging performance of the print head wherein the damping structure comprises a baffle structure and w represents a width of the baffle structure transverse to a direction of flow of the liquid ink and $h_i$ represents a height of a baffle flow passage.

2. The print head of claim 1, wherein the fluid passageways are separate.

3. The print head of claim 1, wherein the first damping structure defines at least three separate fluid passageways.

4. The printer of claim 1, wherein when at least a first manifold and a second manifold are employed to print multiple colors of ink the first manifold is located above the second manifold when the print head is in normal operation.

5. The print head of claim 1, wherein the fluid passageways have a fluid aspect ratio of about 10.

6. The print head of claim 1, wherein the at least one damping structure permits bubbles entrapped in liquid ink in the damping structure to flow up and away from the damping structure when the print head is in normal operation.

7. The print head of claim 1, wherein:

the pressure chambers produce in the manifold, when operated, pressure waves that impinge on the damping structure; and the damping structure has sufficient fluid resistance to reduce reflection of the pressure waves back into the manifold so as to reduce jetting nonuniformity.

8. An ink jet print head having multiple printing nozzles in fluid connection with a supply channel for transporting ink to the print head, comprising:

at least one group of inlet channels connected to the supply channel;

at least one group of pressure chambers, each in fluid connection with a respective one of the inlet channels and operable by action of transducers to cause discharge of liquid ink through one of the nozzles thereby defining a direction of ink flow through the print head, the action of the transducers further being operable to cause the liquid ink to refill the pressure chambers;

at least one manifold in fluid connection between the supply channel and the group of inlet channels, the group of inlet channels opening on the manifold; and at least one group of plural baffles located between the supply channel and the manifold and defining plural fluid passageways between the supply channel and the manifold, the fluid passageways having an aspect ratio $w/h_i$ greater than about 5 so that $h_i$ is sufficiently small such that bubbles entrained in the ink passing through the passageways between the supply channel and the manifold are reduced in size to thereby readily diffuse into the ink to improve purging performance of the print head wherein w represents a width of the baffles transverse to a direction of flow of the liquid ink and $h_i$ represents a height of a baffle flow passage.

9. The print head of claim 8, wherein the baffles comprise major and minor surfaces, the major surfaces being oriented substantially parallel to a direction of ink flow between the supply channel and the manifold when the print head is in normal operation.

10. The print head of claim 8, wherein the plural baffles consist essentially of two baffles.

11. The print head of claim 8, wherein the fluid passageways are separate.

12. The print head of claim 8, wherein the baffles define at least three separate fluid passageways.

13. The printer of claim 8, wherein when at least a first manifold and a second manifold are employed to print multiple colors of ink the first manifold is located above the second manifold when the print head is in normal operation.

14. The print head of claim 8, wherein the fluid passageways defined by the at least one group of baffles have a fluid aspect ratio equal to about 10.

15. The print head of claim 8, wherein the at least one group of baffles permit bubbles entrapped in liquid ink in the group of baffles to flow up through and away from the baffles when the print head is in normal operation.

16. The print head of claim 8, wherein the baffles are disposed so as to provide a passage for liquid ink between each of the baffles from the inlet into either of the chambers.

17. The print head of claim 8, wherein:

the pressure chambers produce in the manifold, when operated, pressure waves that impinge on the baffles; and the baffles have sufficient fluid resistance to reduce reflection of the pressure waves back into the manifold so as to reduce jetting nonuniformity.

18. A method of operating an ink jet print head having multiple nozzles, each in fluid connection with a respective one of multiple pressure chambers containing ink, comprising the steps of:

actuating the pressure chambers to create acoustic pressure wave so as to expel ink from the nozzles thereby defining a direction of ink flow through the print head, the acoustic pressure waves having an amplitude within the print head;

providing the actuated pressure chambers with liquid ink drawn from a manifold;

providing a damping structure with sufficient fluid resistance to reduce the amplitude of acoustic pressure waves when the liquid ink passes therethrough, the damping structure defining a plurality of fluid passageways having a fluid aspect ratio $w/h_i$ of greater than about 5 wherein w represents a width of the baffle structure transverse to a direction of flow of the liquid ink and $h_i$ represents a height of a baffle flow passage such that $h_i$ is sufficiently small so that bubbles entrained in the ink passing through the passageways between the supply channel and the manifold are reduced in size; and providing liquid ink to the manifold by passing the ink from a supply channel through the damping structure to reduce the amplitude of acoustic pressure waves reflecting from the damping structure to the manifold to reduce jetting nonuniformity to an acceptable level so that bubbles entrained in the ink passing through the passageways between the supply channel and the manifold are reduced in size to thereby readily diffuse into the ink to improve purging performance of the print head.

19. The method of clam 18 further comprising providing plural baffles in the damping structure that define at least three fluid passageways from the supply channel to the manifold.

20. The method of claim 19 further comprising providing two parallel plates for each of the plural baffles, each parallel plate having two major surfaces in fluid contact with the ink and being oriented parallel to the direction of fluid flow from the supply channel to the manifold.

21. The method of claim 20, wherein the major plate surfaces are oriented substantially vertically.

22. A phase change ink jet print head having multiple nozzles and operable through use of transducers to cause expulsion of molten liquid ink through the nozzles at an operating temperature, comprising:

a supply channel in fluid communication with an ink source, the ink source holding the liquid ink at a temperature less than the operating temperature;

a manifold in fluid connection with the nozzles, the manifold holding the liquid ink at the operating temperature at which the liquid ink is expelled through the nozzles; and a damping structure connected between and in fluid connection with the supply channel and the manifold and defining plural fluid passageways between the supply channel and the manifold, the print head operable through bending of the transducer to draw liquid ink from the ink source through the passageways into the manifold in a direction of ink flow, the damping structure having dimensions and operating parameters adequate to raise the temperature of liquid ink flowing past at an operating rate to a resultant temperature sufficiently close to the operating temperature to substantially eliminate ink temperature variation as a source of nonuniform expulsion of liquid ink through the nozzles, the passageways defined by the damping structure further having an aspect ratio $w/h_i$ of greater than about 5 wherein w represents a width of the baffle structure transverse to a direction of flow of the liquid ink and $h_i$ represents a height of a baffle flow passage so that $h_i$ is sufficiently small such that bubbles entrained in the ink passing through the passageways between the supply channel and the manifold are reduced in size to thereby readily diffuse into the ink to improve purging performance of the print head.

23. The ink jet print head of claim 22, wherein the damping structure comprises plural baffles that define plural fluid passageways from the supply channel to the manifold.

24. The ink jet print head of claim 23, wherein the baffles comprise two parallel plates, each having two major surfaces oriented parallel to the direction of ink flow from the supply channel to the manifold.

25. The ink jet print head of claim 22, wherein the damping structure comprises plural baffles that define three fluid passageways from the supply channel to the manifold.

26. The ink jet print head of claim 25, wherein the baffles comprise two parallel plates, each having two major surfaces oriented parallel to the direction of ink flow from the supply channel to the manifold.

27. The print head of claim 22, wherein the damping structure is in thermal connection with the manifold.

28. The print head of claim 22, wherein the resultant temperature is within one degree centigrade of the operating temperature.

29. The print head of claims 22, wherein the passageways defined by the damping structure have a fluid aspect ratio of about 10.

30. The method of claim 18, wherein the plurality of passageways defined by the damping structure have a fluid aspect ratio of about 10.

* * * * *